US007942509B2

(12) United States Patent
Kobayashi

(10) Patent No.: US 7,942,509 B2
(45) Date of Patent: May 17, 2011

(54) INK CARTRIDGE ATTACHMENT/DETACHMENT DEVICE AND RECORDING APPARATUS

(75) Inventor: Satoshi Kobayashi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 869 days.

(21) Appl. No.: 11/770,903

(22) Filed: Jun. 29, 2007

(65) Prior Publication Data

US 2008/0002003 A1 Jan. 3, 2008

(30) Foreign Application Priority Data

Jun. 29, 2006 (JP) ..... 2006-179935

(51) Int. Cl.
*B41J 2/175* (2006.01)
*B41J 2/01* (2006.01)

(52) U.S. Cl. ..... 347/86; 347/84; 347/101

(58) Field of Classification Search ..... 347/86, 347/85, 84, 87, 49, 101, 104
See application file for complete search history.

(56) References Cited

U.S. PATENT DOCUMENTS 4,679,106 A * 7/1987 Okita et al. ..... 360/99.06
4,786,998 A * 11/1988 Sugawara et al. ..... 360/99.06
5,222,005 A * 6/1993 Inoue ..... 360/99.06
5,224,079 A * 6/1993 Inoue ..... 369/13.21
5,230,574 A * 7/1993 Namekawa ..... 400/120.16
5,384,757 A * 1/1995 Ohmori et al. ..... 369/13.21
5,436,652 A * 7/1995 Mizoguchi et al. ..... 347/108
5,506,611 A * 4/1996 Ujita et al. ..... 347/86
5,550,570 A * 8/1996 Kurata et al. ..... 347/49
5,971,534 A * 10/1999 Sasaki et al. ..... 347/86
6,246,540 B1 * 6/2001 Kabasawa ..... 360/99.06
6,442,352 B1 * 8/2002 Ito ..... 396/536
6,779,880 B1 * 8/2004 Kulpa et al. ..... 347/86
7,111,842 B2 * 9/2006 Taku ..... 271/241
7,455,397 B2 * 11/2008 Sakai et al. ..... 347/86
2003/0053249 A1 * 3/2003 Komatsu et al. ..... 360/99.06
2004/0085398 A1 * 5/2004 Hirashima et al. ..... 347/49
2004/0119799 A1 * 6/2004 Kulpa et al. ..... 347/86
2005/0168545 A1 * 8/2005 Sakai et al. ..... 347/86
2006/0256172 A1 * 11/2006 Kobayashi ..... 347/86

FOREIGN PATENT DOCUMENTS

JP 09-123479 5/1997

(Continued)

*Primary Examiner* — Stephen D Meier
*Assistant Examiner* — Leonard S Liang
(74) *Attorney, Agent, or Firm* — Workman Nydegger

(57) ABSTRACT

An ink cartridge attachment/detachment device that loads an ink cartridge into a main body of a recording apparatus by sliding the ink cartridge into includes an ejection lever and an urging force adjustment device. The ejection lever contacts the ink cartridge and urges the ink cartridge using an urging force of an urging device in an ejecting direction in which the ink cartridge is ejected when the ink cartridge is loaded or when the ink cartridge is ejected. The urging force adjustment device changes a ratio of a force with which the urging device urges the ejection lever in a pivotal direction in which the ejection lever is pivoted to a force with which the urging device urges the ejection lever in a radial direction about a pivotal fulcrum of the ejection lever. The urging force adjustment device reduces the force with which the urging device urges the ejection lever in the radial direction as the ejection lever is pivoted in the ejecting direction, and the urging force adjustment device increases the force with which the urging device urges the ejection lever in the radial direction as the ejection lever is pivoted in a loading direction in which the ink cartridge is loaded.

7 Claims, 29 Drawing Sheets

FOREIGN PATENT DOCUMENTS

| | | | |
|---|---|---|---|
| JP | 11-157094 | | 6/1999 |
| JP | 2005-074981 | | 3/2005 |
| JP | 2005-138338 | | 6/2005 |
| JP | 2005-219416 | | 8/2005 |
| JP | 2005-254794 | | 9/2005 |
| JP | 2007105960 A | * | 4/2007 |

* cited by examiner

INK CARTRIDGE ATTACHMENT/DETACHMENT DEVICE AND RECORDING APPARATUS

BACKGROUND

1. Technical Field

The present invention relates to an ink cartridge attachment/detachment device that loads an ink cartridge into the main body of a recording apparatus by sliding the ink cartridge into. The invention also relates to a recording apparatus and a liquid ejecting apparatus, which are provided with the ink cartridge attachment/detachment device.

Here, examples of the liquid ejecting apparatus include not only a recording apparatus, such as an ink jet recording apparatus, a photocopier, or a facsimile machine, that ejects ink from a recording head, serving as a liquid ejecting head, to perform recording onto a recording target material, such as recording paper sheet, but also an apparatus that ejects a liquid for a specific purpose, instead of ink, from a liquid ejecting head, which corresponds to the above-mentioned recording head, onto an ejected-liquid target material corresponding to the recording target material, to attach a liquid to the ejected-liquid target material. In addition to the above described example recording head, examples of the liquid ejecting head include a color material ejecting head used for manufacturing a color filter for a liquid crystal display, or the like, an electrode material (conductive paste) ejecting head used for forming an electrode for an organic EL display, a field emission display (FED), or the like, a bio-organic material ejecting head used for manufacturing a bio-chip, a sample ejecting head that ejects a sample in the same manner as a precision pipette, and the like.

2. Related Art

An existing ink cartridge attachment/detachment device loads an ink cartridge by pivoting a lever using the principle of leverage, which is described, for example, in Japanese Unexamined Patent Application Publication No. 11-157094. When the ink cartridge is ejected, a link lever, which is interlocked with the rotation of the lever, is engaged with the ink cartridge to move the ink cartridge in a direction in which the ink cartridge is ejected. However, because a large-capacity multicolor ink cartridge is used, the size and weight of the ink cartridge are large. Hence, a load required for ejecting the ink cartridge is also large. To assist the ejection of ink cartridge, the main body of the attachment/detachment device is provided with an ejection lever that always urges the ink cartridge in the ejecting direction using the urging force of a spring.

Because the ejection force of the ejection lever for the ink cartridge needs to exceed an ejecting resistance, such as a frictional resistance, or the like, generated between the ink cartridge and the main body of the attachment/detachment device, the urging force of the ejection lever employs a strong spring force. Accordingly, when the ink cartridge is loaded into the attachment/detachment device, a strong ejection force owing to the strong spring is retained by the attachment/detachment device. If such an existing structure is used as it is, in a trying environment, for example, at the temperature of 85 degrees C. or 105 degrees C. in an in-vehicle environment, members such as an ink cartridge, and the like, may be gradually deformed (so-called creep) under the influence of the retained strong ejection force. In addition, such creep may also occur at room temperature.

SUMMARY

An advantage of some aspects of the invention is that an ink cartridge attachment/detachment device that is capable of reducing the occurrence of creep when the loading of an ink cartridge is completed even when a spring having a strong urging force is used for ensuring a strong ejection force is provided.

A first aspect of the invention provides an ink cartridge attachment/detachment device that loads an ink cartridge into a main body of a recording apparatus by sliding the ink cartridge into. The ink cartridge attachment/detachment device includes an ejection lever and an urging force adjustment device. The ejection lever contacts the ink cartridge and urges the ink cartridge using an urging force of an urging device in an ejecting direction in which the ink cartridge is ejected when the ink cartridge is loaded or when the ink cartridge is ejected. The urging force adjustment device changes a ratio of a force with which the urging device urges the ejection lever in a pivotal direction in which the ejection lever is pivoted to a force with which the urging device urges the ejection lever in a radial direction about a pivotal fulcrum of the ejection lever. The urging force adjustment device reduces the force with which the urging device urges the ejection lever in the radial direction as the ejection lever is pivoted in the ejecting direction, and the urging force adjustment device increases the force with which the urging device urges the ejection lever in the radial direction as the ejection lever is pivoted in a loading direction in which the ink cartridge is loaded. Here, the "ejecting direction" means a direction in which the ink cartridge is moved when the ink cartridge is ejected. On the other hand, the "loading direction" is a direction opposite to the "ejecting direction".

According to the first aspect of the invention, the urging force adjustment device of the ink cartridge attachment/detachment device is configured to reduce a ratio of the force with which the urging device urges the ejection lever in the radial direction as the ejection lever is pivoted in the ejecting direction and to increase a ratio of the force with which the urging device urges the ejection lever in the radial direction as the ejection lever is pivoted in the loading direction. Thus, when the loading of the ink cartridge is completed, the urging device is able to reduce a force that urges in the pivotal direction of the ejection lever in comparison to another state such as a state where the ink cartridge is being loaded or a state where the ink cartridge is being ejected. As a result, because an ejection force that is applied to the ink cartridge in the ejecting direction may be reduced when the loading of the ink cartridge is completed, it is possible to reduce a so-called "creep" in which the ink cartridge is moved or deformed so as to move away in the ejecting direction.

According to a second aspect of the invention, in the ink cartridge attachment/detachment device according to the first aspect, the urging device may be engaged at one end with a base portion of the ink cartridge attachment/detachment device, while the urging device may be engaged at the other end with an arm portion of the ejection lever, and the urging force adjustment device may adjust a force that is applied in the pivotal direction of the ejection lever so that, as the ejection lever is pivoted, a straight line formed by connecting the pivotal fulcrum of the ejection lever and an engaging portion at which the arm portion of the ejection lever engages the urging device approaches and then moves away from an engaging portion at which the base portion engages the urging device.

According to the second aspect, in addition to the same functions and effects as those in the first aspect, the urging device is engaged at one end with the base portion of the ink cartridge attachment/detachment device, while the urging device is engaged at the other end with an arm portion of the ejection lever, and the urging force adjustment device adjusts a force that is applied in the pivotal direction of the ejection lever so that, as the ejection lever is pivoted, a straight line formed by connecting the pivotal fulcrum of the ejection lever and an engaging portion at which the arm portion of the ejection lever engages the urging device approaches and moves away an engaging portion at which the base portion engages the urging device. Thus, the urging force adjustment device may be easily formed.

In addition, in the above configuration, the movement distance of the ink cartridge and the pivot distance of the ejection lever are not proportional to a force that is applied in the pivotal direction of the ejection lever. In other words, where a force that is applied in the pivotal direction of the ejection lever is F, a vector angle made by the above straight line and a straight line formed by connecting the engaging portion at which the base portion engages the urging device and the engaging portion at which the arm portion of the ejection lever engages the urging device, that is, an urging direction of the urging device, is $\theta$, and an urging force of the urging device is A, the relational expression $F=A \sin \theta$ is obtained.

Thus, it is possible to sharply reduce a force that is applied in the pivotal direction of the ejection lever when the loading of the ink cartridge is completed. In other words, when the ink cartridge is ejected, it is possible to ensure the urging force applied to the ejection lever equal to or above a predetermined value, while making the urging force, that is applied to the ejection lever upon completion of the loading, approximate to almost nothing. In addition, owing to the variation of $\sin \theta$, it is possible to change a ratio of a force with which the urging device urges the ejection lever in the pivotal direction of the ejection lever to a force with which the urging device urges the ejection lever in the radial direction about the pivotal fulcrum of the ejection lever. That is, even when the urging force of the urging device is strong, it is possible to reduce or eliminate a force applied in the pivotal direction of the ejection lever.

According to a third aspect of the invention, in the ink cartridge attachment/detachment device according to the second aspect, the ink cartridge attachment/detachment device further includes a cartridge holder and a power transmitting and converting mechanism. The cartridge holder is made to hold the ink cartridge by inserting the ink cartridge by a first predetermined stroke. The power transmitting and converting mechanism ensures a pressing force required for loading the ink cartridge by using a leverage principle when an lever arm is pivoted, while the power transmitting and converting mechanism converts a pivotal movement of the lever arm into a movement of a second predetermined stroke required for loading the ink cartridge which is held by the cartridge holder. When the ink cartridge is ejected, the cartridge holder is moved in the ejecting direction by the second predetermined stroke as the cartridge holder releases the ink cartridge held by the cartridge holder by pivotal movement of the lever arm. The cartridge holder contacts the ejection lever to pivot the ejection lever in the ejecting direction within a range of the second predetermined stroke, while the cartridge holder makes the urging force adjustment device increase an urging force that the urging device applies in the ejecting direction that coincides with the pivotal direction of the ejection lever.

Here, the "insertion of the ink cartridge" means a state where the ink cartridge is inserted from the outside of the recording apparatus into the recording apparatus and is held by the cartridge holder. In addition, the "loading of the ink cartridge" means a state where the ink cartridge that is held by the cartridge holder is further pressed in together with the cartridge holder and stuck with an ink supply needle by the pivotal movement of the lever arm.

According to the third aspect of the invention, in addition to the same functions and effects as those in the second aspect, when the ink cartridge is ejected, the cartridge holder moves in the ejecting direction by the second predetermined stroke as the cartridge holder releases the ink cartridge held by the cartridge holder by pivotal movement of the lever arm. The cartridge holder contacts the ejection lever to pivot the ejection lever in the ejecting direction within a range of the second predetermined stroke, while the cartridge holder makes the urging force adjustment device increase an urging force that which the urging device applies in the ejecting direction that coincides with the pivotal direction of the ejection lever. Accordingly, when the ink cartridge is ejected in a state where the ink cartridge is loaded, it is possible to increase the urging force of the urging device in the pivotal direction of the ejection lever even when the urging force of the urging device in the pivotal direction of the ejection lever is nothing or almost nothing. That is, the cartridge holder is a so-called trigger to make the urging force adjustment device increase the urging force in the ejecting direction of the urging device.

According to a fourth aspect of the invention, in the ink cartridge attachment/detachment device according to the third aspect, the ink cartridge attachment/detachment device may be configured so that, when the ink cartridge is ejected, the cartridge holder pivots the ejection lever after the cartridge holder has released the ink cartridge.

According to the fourth aspect of the invention, in addition to the same functions and effects as those in the third aspect, the ink cartridge attachment/detachment device is configured so that, when the ink cartridge is ejected, the cartridge holder pivots the ejection lever after the cartridge holder has released the ink cartridge. Thus, the urging force of the urging device does not hinder a releasing action with which the cartridge holder releases the ink cartridge held by the cartridge holder.

According to a fifth aspect of the invention, in the ink cartridge attachment/detachment device according to the fourth aspect, the ink cartridge attachment/detachment device may be configured so that, in a state where the ink cartridge is completely loaded, the engaging portion, at which the base portion engages the urging device, the pivotal fulcrum of the ejection lever and the engaging portion, at which the arm portion of the ejection lever engages the urging device, are aligned in a line.

According to the fifth aspect of the invention, in addition to the same functions and effects as those in the fourth aspect, the ink cartridge attachment/detachment device is configured so that, in a state where the ink cartridge is completely loaded, the engaging portion, at which the base portion engages the urging device, the pivotal fulcrum of the ejection lever and the engaging portion, at which the arm portion of the ejection lever engages the urging device, are aligned in a line. Thus, in a state where the ink cartridge is completely loaded, it is possible to completely eliminate a force that the urging device applies in the pivotal direction of the ejection lever.

At the same time, an ejecting force which the ejection lever applies the ink cartridge is also completely eliminated. That is, only at the engaging portion at which the base portion engages the urging device, the pivotal fulcrum of the ejection lever and the engaging portion at which the arm portion of the ejection lever engages the urging device, the urging force of the urging device is applied in a radial direction perpendicular to the pivotal direction about the pivotal fulcrum, and no force is applied to the other members. Thus, in regard to the other members, it is possible to completely prevent the occurrence of creep due to the urging force of the ejection lever.

According to a sixth aspect of the invention, in the ink cartridge attachment/detachment device according to any one of the above first through fifth aspects, the ejection lever may be configured so as to contact and press a middle portion of the ink cartridge in a width direction relative to the ejecting direction of the ink cartridge.

According to the sixth aspect, in addition to the same functions and effects as those in one of the first to fifth aspects, the ejection lever is configured so as to contact and press a middle portion of the ink cartridge in a width direction relative to the ejecting direction of the ink cartridge. Accordingly, it is possible to move the ink cartridge in the ejecting direction while stabilizing the attitude of the ink cartridge.

A seventh aspect of the invention provides a recording apparatus. The recording apparatus includes an ink cartridge attachment/detachment device that loads the ink cartridge into a main body of the recording apparatus by sliding the ink cartridge into and a recording portion that performs recording by discharging ink onto a recorded medium. The above ink cartridge attachment/detachment device is the ink cartridge attachment/detachment device according to any one of the first to sixth aspects. According to the seventh aspect of the invention, in the ink cartridge attachment/detachment device, the same functions and effects as those in any one of the first to sixth aspects may be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
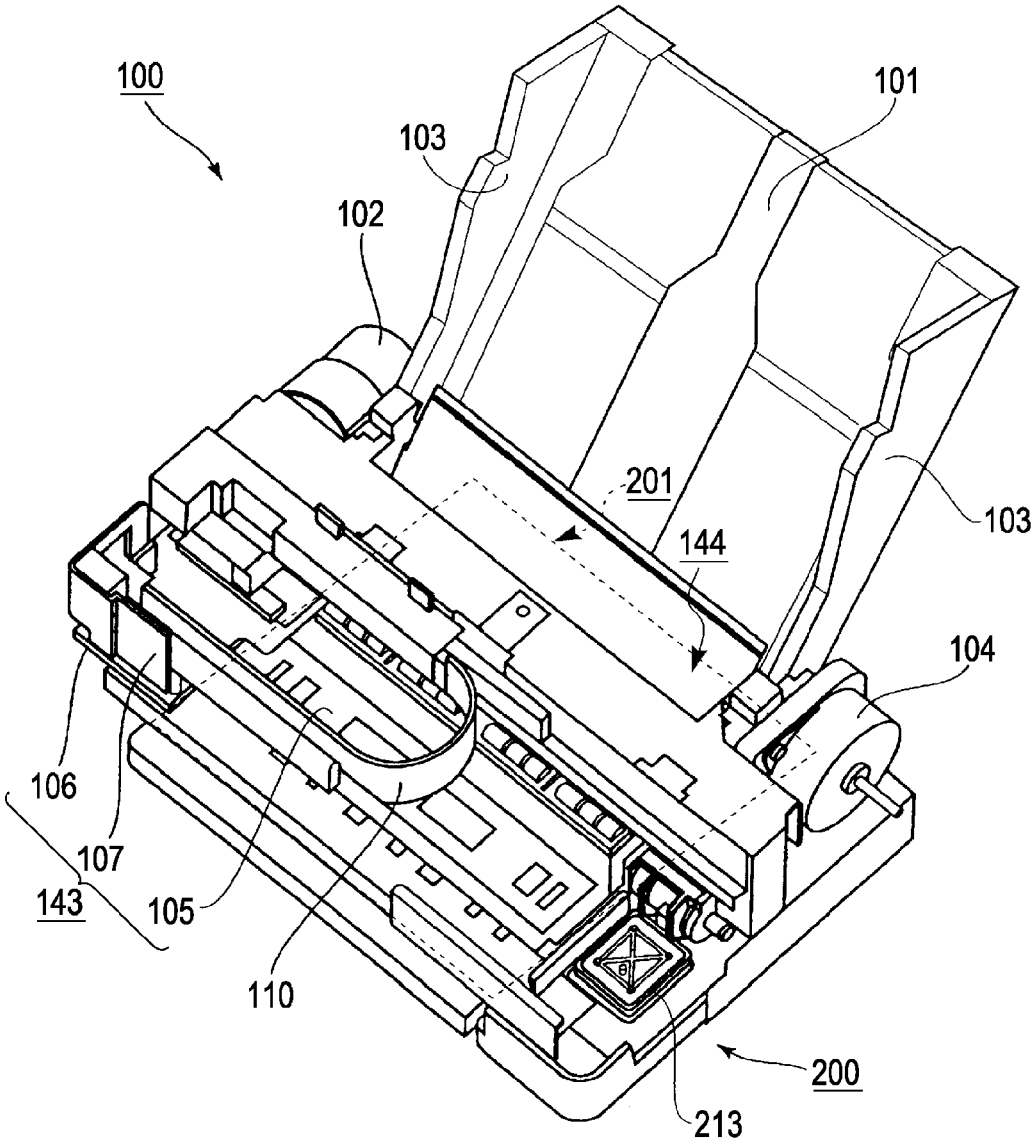
FIG. 1 is an overall schematic perspective view of a recording apparatus according to an embodiment which is prerequisite for an aspect of the invention.
Figure 2:
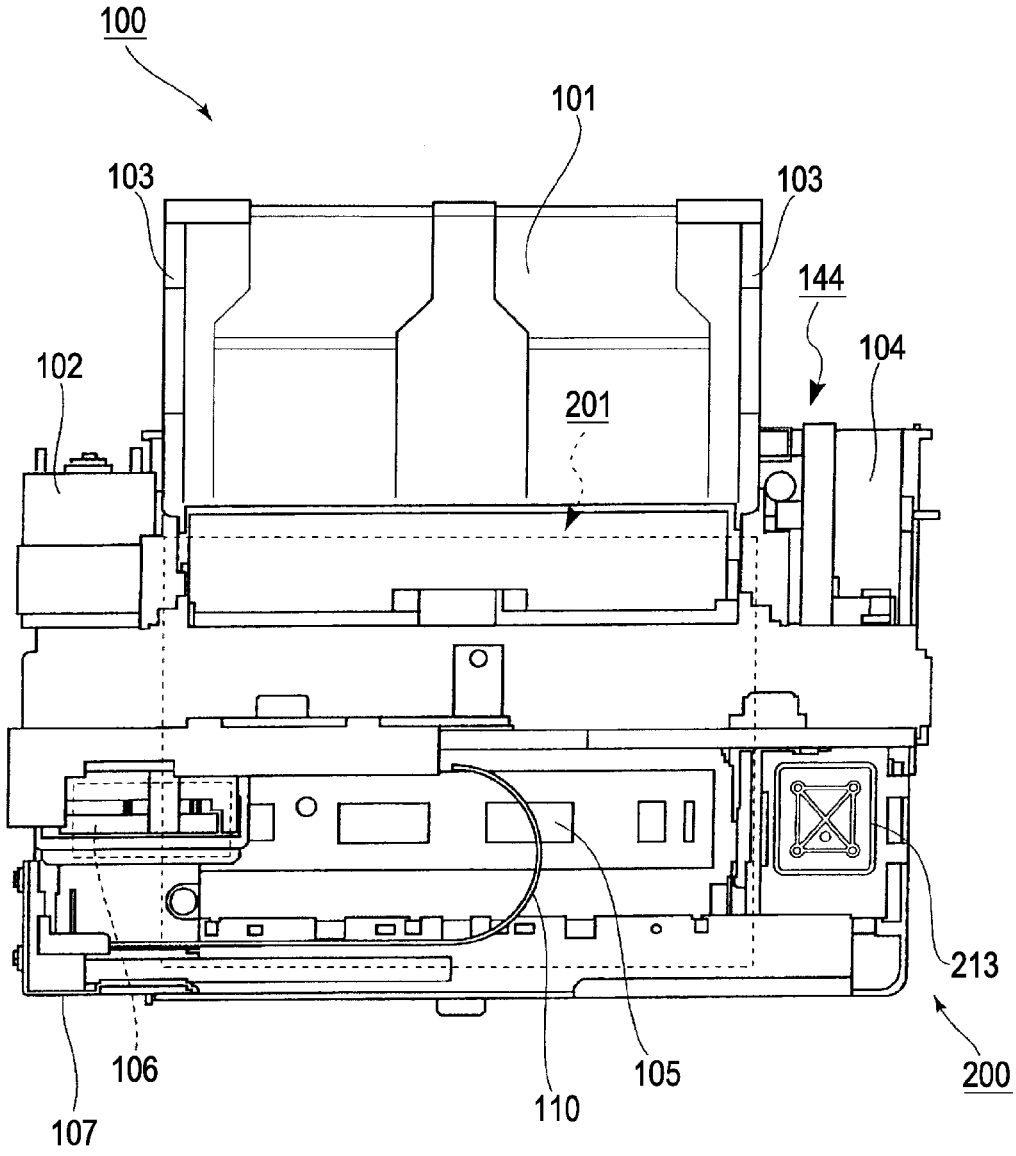
FIG. 2 is an overall schematic plan view of the recording apparatus according to an embodiment which is prerequisite for the aspect of the invention.

An embodiment, which is a prerequisite for an aspect of the invention, will be described with reference to the accompanying drawings. FIG. 1 is an overall schematic perspective view of the recording apparatus according to an embodiment. FIG. 2 is an overall schematic plan view of the recording apparatus according to the embodiment.

A hopper 101 is provided at a back side of the main body of a recording apparatus 100, on which paper sheets, or recording media, are stacked. The hopper 101 is swingable about a fulcrum on the upper side. An uppermost paper sheet that is stacked on the hopper 101 is fed by a feeding portion 144 toward a recording portion located downstream in a transport direction in which the paper sheet is transported. Specifically, the stacked paper sheet is picked up by a feed roller (not shown) that is driven by a feeding motor 104 and is fed to a transport roller (not shown), which is located downstream in the transport direction, as the paper sheet is guided by a paper guide 103. The paper sheet that has been fed to the transport roller is transported by the transport roller driven by a transporting motor (not shown) to a recording portion 143 located further downstream in the transport direction. The recording portion 143 includes a platen 105 that supports a paper sheet from underneath and a carriage 107 that is provided above and opposite the platen 105. The carriage 107 is driven by a carriage motor 102 as it is guided by a carriage guide shaft (not shown) that extends in a main scanning direction. Furthermore, a recording head 106 that discharges ink toward a paper sheet is provided on a lower surface of the carriage 107. The paper sheet that has been recorded upon at the recording portion 143 is further transported downstream and delivered from the front side of the recording apparatus 100 by a delivery roller (not shown).

An ink cartridge 211 (see FIG. 3) is loaded in an attachment/detachment device 201 located at the lower side of the main body of the recording apparatus 100, and ink is supplied through an ink supply needle 411 (see FIG. 7) to an ink supply passage (not shown). Further, the ink is supplied through an ink supply tube 110 to the recording head 106 of the carriage 107. Then, in flushing or cleaning of the recording head 106, discharge and suction of ink are performed by an ink suction device 200 that is provided at one end and serves as a discharge characteristic maintaining portion to maintain discharge characteristics of the recording portion 143. The ink suction device 200 is provided with a cap portion 213 and is configured to be able to seal the recording head 106 by moving the cap portion 213 up and down.

Figure 3:
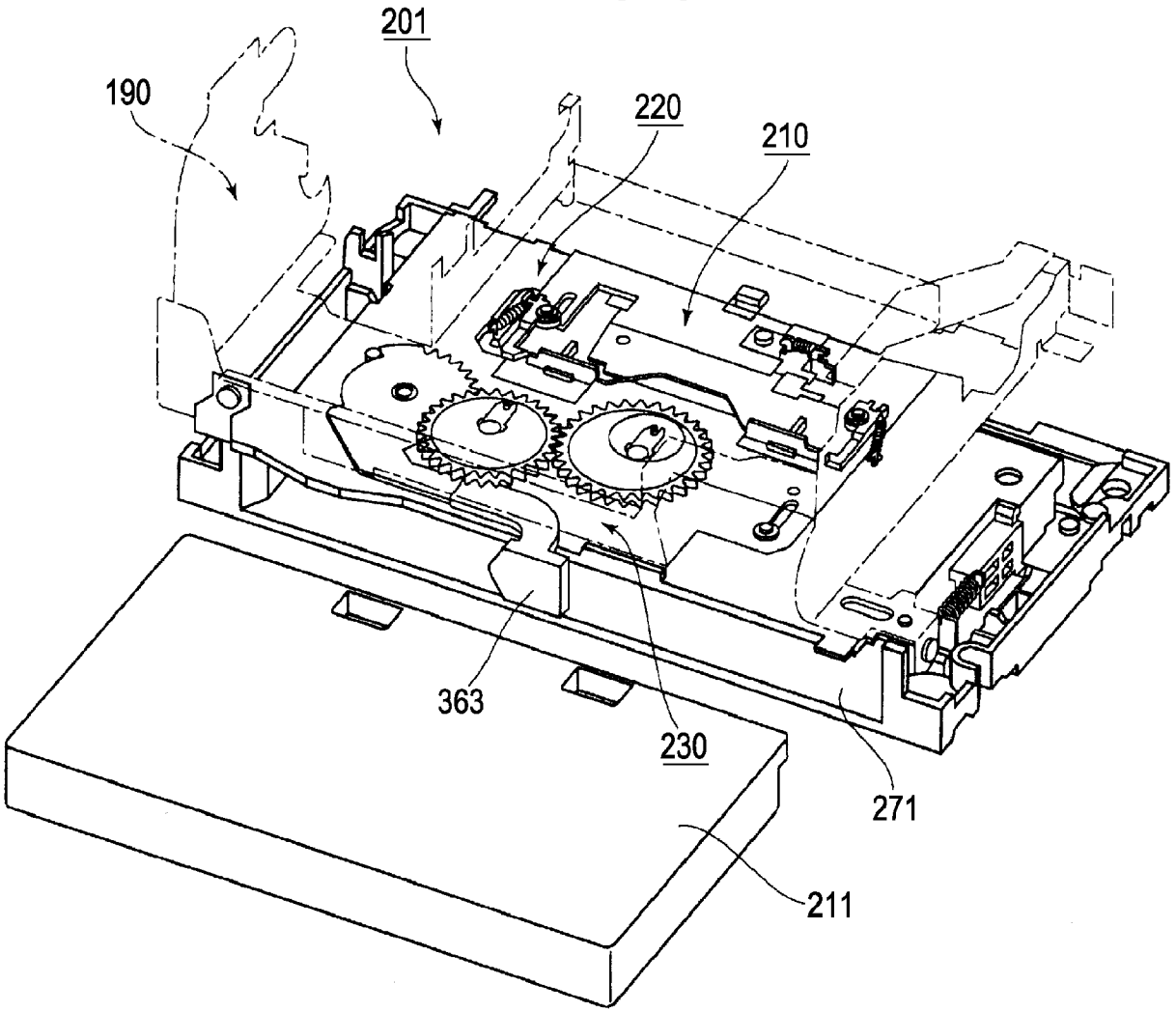
FIG. 3 is an overall schematic perspective view of an attachment/detachment device according to an embodiment which is prerequisite for the aspect of the invention.

FIG. 3 is an overall schematic perspective view of the attachment/detachment device according to the embodiment. As shown in FIG. 3, an ink cartridge attachment/detachment device 201 is provided with an insertion opening 271 into which the ink cartridge 211 is inserted. The insertion opening 271 is provided on the back side of the recording apparatus 100 shown in FIGS. 1 and 2. The ink cartridge attachment/detachment device 201 includes a lever arm 363, a power transmitting and converting mechanism 230, a cartridge holder 210, and a cartridge lock releasing device 220. The lever arm 363 is manipulated by a user. The power transmitting and converting mechanism 230 converts power of the lever arm 363 into movement of a second predetermined stroke S2 (see FIG. 11) that is required for loading the ink cartridge 211. The cartridge holder 210 holds the ink cartridge 211 that is inserted through the insertion opening 271 by the first predetermined stroke S1 (see FIG. 8). The cartridge lock releasing device 220 releases the ink cartridge 211 that is held by the cartridge holder 210 when the ink cartridge 211 is ejected. The following will describe the configuration and movement of these components in order.

A transport portion for transporting a paper sheet and a frame member 190, formed of a metal plate, on which the recording portion, or the like, is mounted for performing recording onto a paper sheet, are provided above the attachment/detachment device 201. The frame member 190, in a state where the attachment/detachment device 201 is loaded with the ink cartridge 211, is configured so as to engage a portion that is not opposite the ink cartridge 211, that is, a portion of the side wall surface adjacent to the side end of the attachment/detachment device 201. In this manner, it is possible to prevent an increase in friction between the attachment/detachment device 201 and the ink cartridge 211 by the attachment/detachment device 201 being deformed due to the weight that acts on the frame member 190 upon insertion, loading, or ejection of the ink cartridge 211. In addition, the connection between the frame member 190 and other components arranged above the frame member 190 may be released from the side, and the frame member 190 and the attachment/detachment device 201 arranged below the frame member 190 may be separately removed. In other words, it is possible to easily remove only the attachment/detachment device 201 from the entire recording apparatus.

Figure 4:
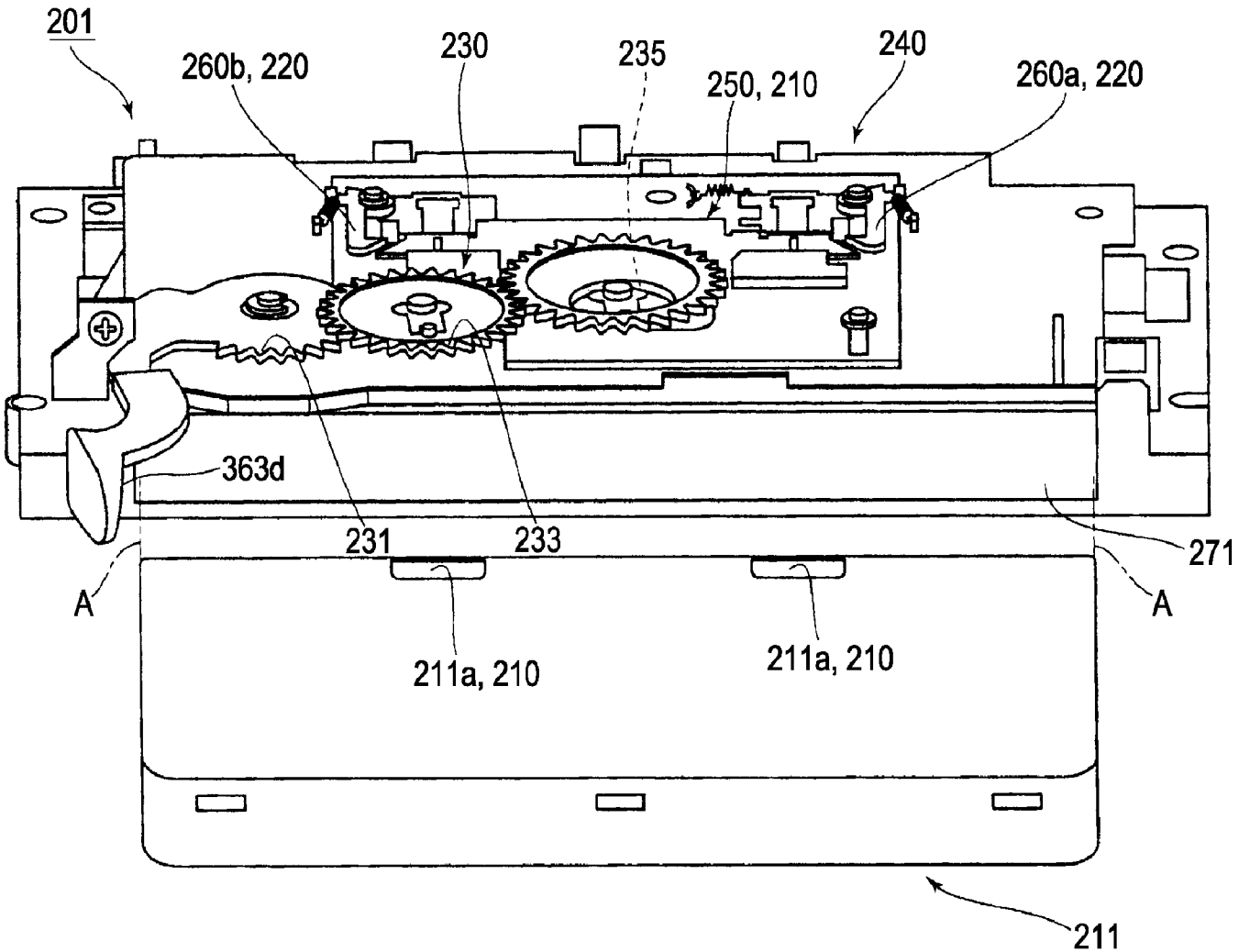
FIG. 4 is a front perspective view of the attachment/detachment device in a state where the lever is in a reset position before the ink cartridge is inserted.
Figure 5:
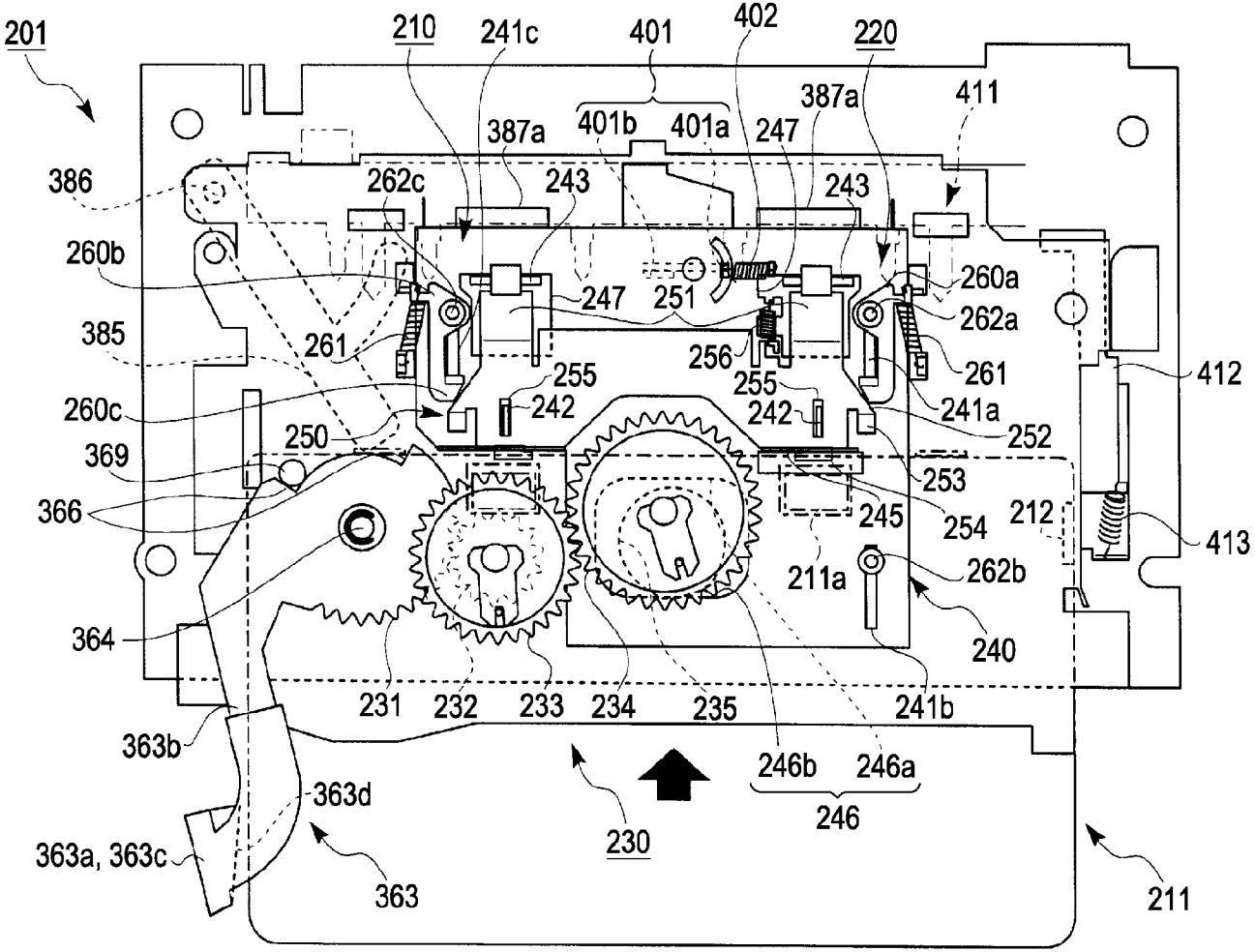
FIG. 5 is a plan view of the attachment/detachment device in a state where the lever is in the reset position when the ink cartridge is being inserted.
Figure 6:
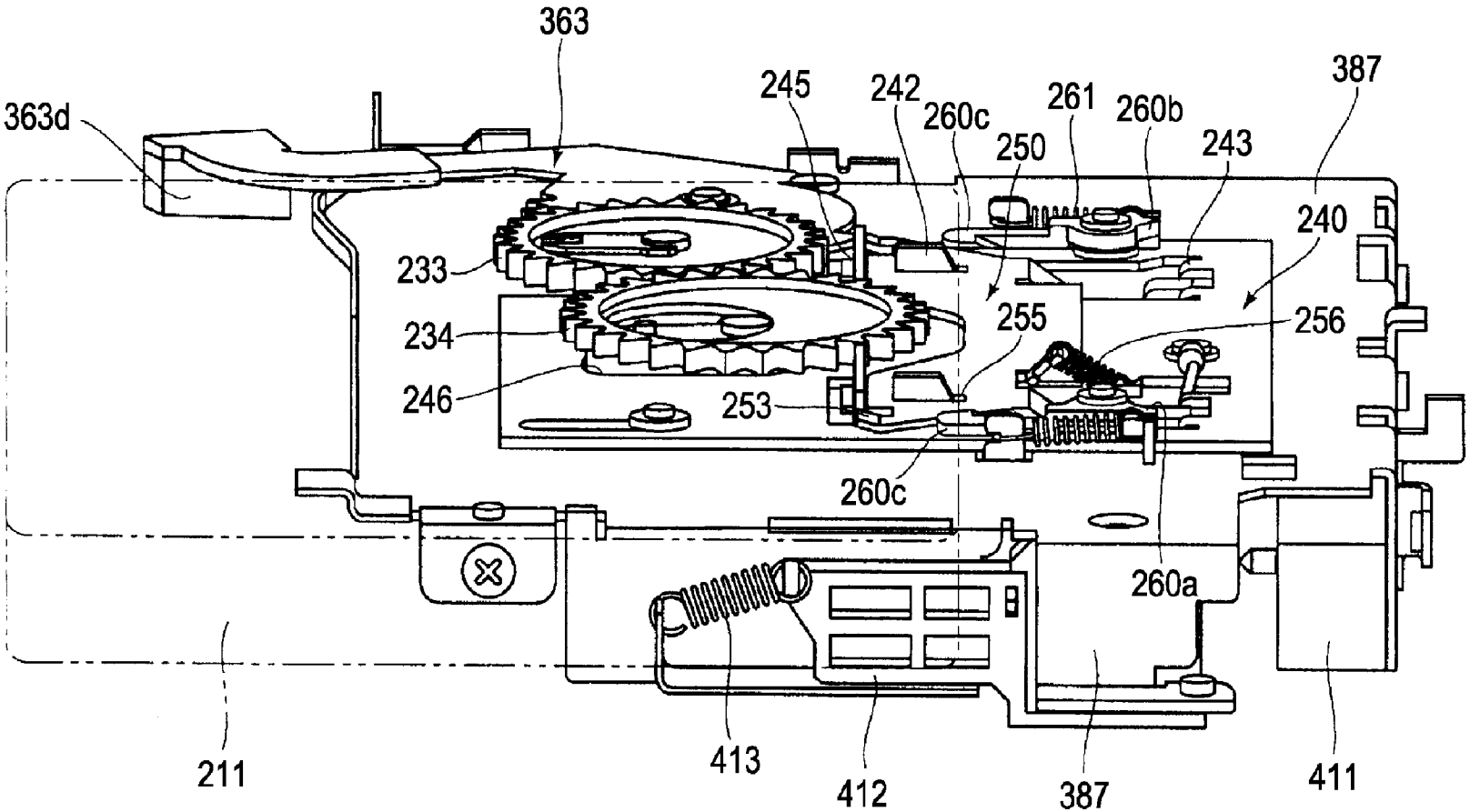
FIG. 6 is a side perspective view of the attachment/detachment device in a state where the lever is in the reset position when the ink cartridge is being inserted.
Figure 7:
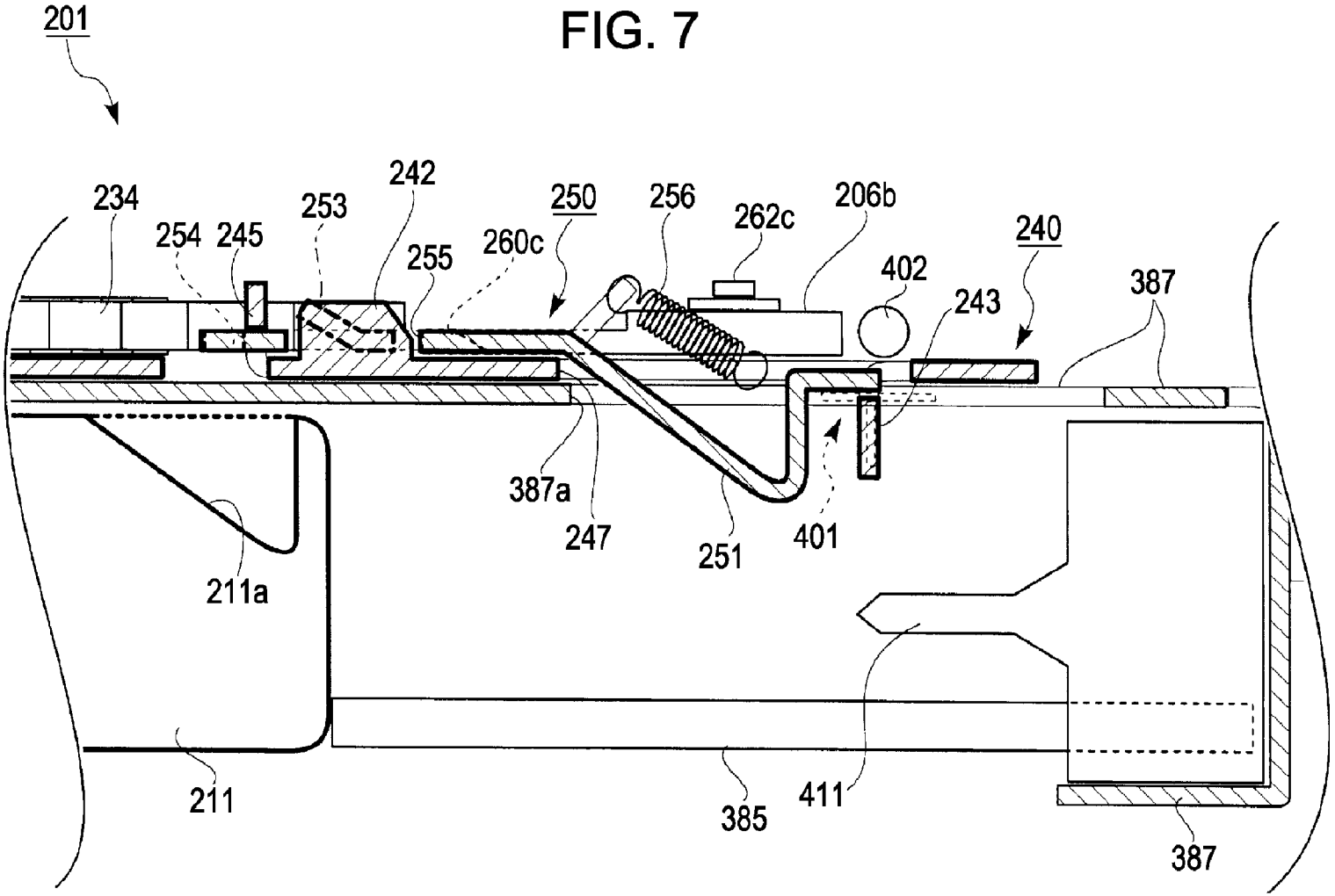
FIG. 7 is a side cross-sectional view of a relevant part of the attachment/detachment device in a state where the lever is in the reset position when the ink cartridge is being inserted.

FIG. 4 is a front perspective view of the attachment/detachment device in a state where the lever arm is in a reset position before the ink cartridge is inserted. FIG. 5 is a plan view of the attachment/detachment device in a state where the lever arm is in the reset position and when the ink cartridge is being inserted. FIG. 6 is a side perspective view of FIG. 5. FIG. 7 is a side cross-sectional view of a relevant part of FIG. 5. As shown in FIGS. 4 to 7, the attachment/detachment device 201 of the ink cartridge 211 includes the power transmitting and converting mechanism 230, the cartridge holder 210, and the cartridge lock releasing device 220.

The power transmitting and converting mechanism 230 includes the lever arm 363, a first gear 231, a second gear 232, a third gear 233, a fourth gear 234, a cam portion 235, and a slider portion 240. The first gear 231 is provided on the lever arm 363. The second gear 232 meshes with the first gear 231 so as to transmit power therebetween. The third gear 233 is integrally formed with the second gear 232. The fourth gear 234 meshes with the third gear 233 so as to transmit power therebetween. The cam portion 235 is integrally formed with the fourth gear 234. The slider portion 240, serving as a cam follower, contacts the cam portion 235. The slider portion 240 is provided with a first slider opening 246 and is movable in the loading and ejecting directions such that the cam portion 235 contacts and presses a first surface 246*a* or second surface 246*b* of the first slider opening 246.

Note that the cam portion 235 includes an eccentric cam portion that moves the slider portion 240 and a concentric cam portion that accurately positions the slider portion 240 and the second predetermined stroke S2. Here, the moving direction in which the slider portion 240 moves is restricted by shafts 262*a*, 262*b* that are inserted through two guide slits 241*a*, 241*b* formed along the moving direction of the slider portion 240.

In the embodiment, the lever arm 363 is configured so as to pivot about a lever pivot shaft 364. The position of the lever arm 363 shown in FIGS. 4 to 10 is defined as a "reset position" of the lever arm 363, and the position of the lever arm 363 shown in FIGS. 13 to 16 is defined as a "set position" of the lever arm 363. The pivotal range of the lever arm 363 is restricted by a lever pivot restricting protrusion 369 provided on a base portion 387 of the main body of the attachment/detachment device and two lever pivot restricting portions 366 provided on the lever arm 363. Accordingly, the lever arm 363 may pivot only between the "set position" and the "reset position".

In addition, the cartridge holder 210 includes the slider portion 240 having a latch plate 250 on which two pawl portions 251 of the attachment/detachment device are formed and two recesses 211*a* of the ink cartridge, which are engageable with the pawl portions 251. The latch plate 250 is configured so that the pawl portion side of the latch plate 250 is swingable up and down in FIG. 7 relative to the slider portion 240 about the position where latch plate engaging portions 254 opposite the pawl portions 251 engage slider engaging portions 245 of the slider portion 240. Then, the latch plate 250 is arranged on the upper surface of the slider portion 240, and two pawl portions 251 of the latch plate 250 are configured so as to extend downward through two second slider openings 247 of the slider portion 240. The base portion 387 of the attachment/detachment device 201 is also provided with a base opening 387*a* so as not to interfere with the engagement between the pawl portions 251 and the recesses 211*a*.

The slider engaging portions 245 are formed by bending and provided at the middle portion of the slider portion 240 in the loading direction. The slider engaging portions 245 are engageable with latch plate engaging portions 254, which are formed on the upstream side of the latch plate 250 in the loading direction. In this embodiment, the slider engaging portion 245 and the latch plate engaging portion 254 forms a first engaging device. Then, the latch plate 250 is provided swingably about the position at which the first engaging device engages. Note that in the description, the "engagement of the first engaging device" means a state where the slider engaging portion 245 is in surface contact with the latch plate engaging portion 254.

In addition, the slider portion 240 is also provided with slider protrusions 242 that extend in the loading direction and in the swinging direction of the latch plate 250 by bending the slider protrusions 242 toward a direction perpendicular to the loading direction. The slider protrusions 242 are provided engageably with perforated latch plate slits 255, which are formed in the latch plate 250 so as to extend in the loading direction. In this embodiment, the slider protrusion 242 and the latch plate slit 255 form a second engaging device. Then, when no external force is applied to the latch plate 250, a latch plate spring 256 urges so that the latch plate 250 and the slider portion 240 are engaged with each other by the first engaging devices, while the latch plate spring 256 urges the pawl portions 251 of the latch plate 250 downward. Note that in the description, the engagement of the second engaging device means that the slider protrusion 242 presses a surface of the latch plate slit 255 on the loading direction side so that they are in surface contact with each other.

Furthermore, the cartridge lock releasing device 220 includes slope portions 253 that are formed with the latch plate 250 and cancel arms 260*a*, 260*b*. The cancel arms 260*a*, 260*b* are provided on both sides of the latch plate 250 in the width direction relative to the loading direction. The cancel arms 260*a*, 260*b*, only when the ink cartridge 211 is ejected, contact the slope portions 253 to lift the latch plate 250 upward. The cancel arms 260*a*, 260*b* are configured to be able to pivot against an urging force of cancel arm springs 261 about the shafts 262*a*, 262*c*.

A further detailed description will be given of the movement of the attachment/detachment device 201. Note that in the embodiment, because the slider portion 240 and the latch plate 250 are formed of metal plate, it is possible to accurately, so-called rigidly, position the latch plate 250. In addition, even when the attachment/detachment device 201 is left under high-temperature conditions, it is unlikely to be deformed.

Insertion of Ink Cartridge

Next, the movement of the ink cartridge 211 will be described separately in insertion, loading, and ejection. First, the ink cartridge 211 shown in FIG. 4 is inserted from a state where the ink cartridge 211 is located outside the attachment/detachment device 201 into the insertion opening 271. A lever protrusion 363*c* of a knob portion 363*a* is formed at the distal end of the arm body 363*b* of the lever arm 363 and is provided with a guide face 363*d*. The guide face 363*d* is formed so as to guide the ink cartridge 211 toward the insertion opening 271 when a user inserts the ink cartridge 211 into the insertion opening 271. Specifically, the guide face 363*d* is formed so as to be inclined relative to the loading direction of the ink cartridge 211. This is because the guide face 363*d* gradually pushes back the ink cartridge 211 that runs off an approaching path A extending in a direction opposite the insertion opening 271 to the approaching path A as it approaches the insertion opening 271. Here, the loading direction means a direction in which the ink cartridge 211 goes into the insertion opening 271 toward the ink supply needle 411 at the innermost of the insertion opening 271. Specifically, the loading direction is a direction indicated by an arrow extending from the lower side toward the upper side in FIG. 5.

As the distal end of the ink cartridge 211 is inserted into the insertion opening 271, the distal end portion of the ink cartridge 211 encounters a first ejection lever 385 provided at an innermost portion of the insertion opening 271. The first ejection lever 385 is provided so as to pivot about an ejection lever shaft 386 and always urge the ink cartridge 211 by a spring (not shown) in the ejecting direction in which the ink cartridge 211 is ejected. Here, the ejecting direction means a direction opposite to the loading direction.

FIGS. 5 to 7 show a state where the ink cartridge 211 has encountered the first ejection lever 385 and stopped. In this state, because the side face of the ink cartridge 211 crosses the locus of the lever protrusion 363*c*, it is impossible to pivot the lever arm 363 located in the reset position toward the set position. Accordingly, it is possible to prevent a manipulation, a so-called erroneous manipulation (abnormal manipulation), in which a user pushes the ink cartridge 211 in the loading direction by the lever protrusion 363*c*.

Figure 8:
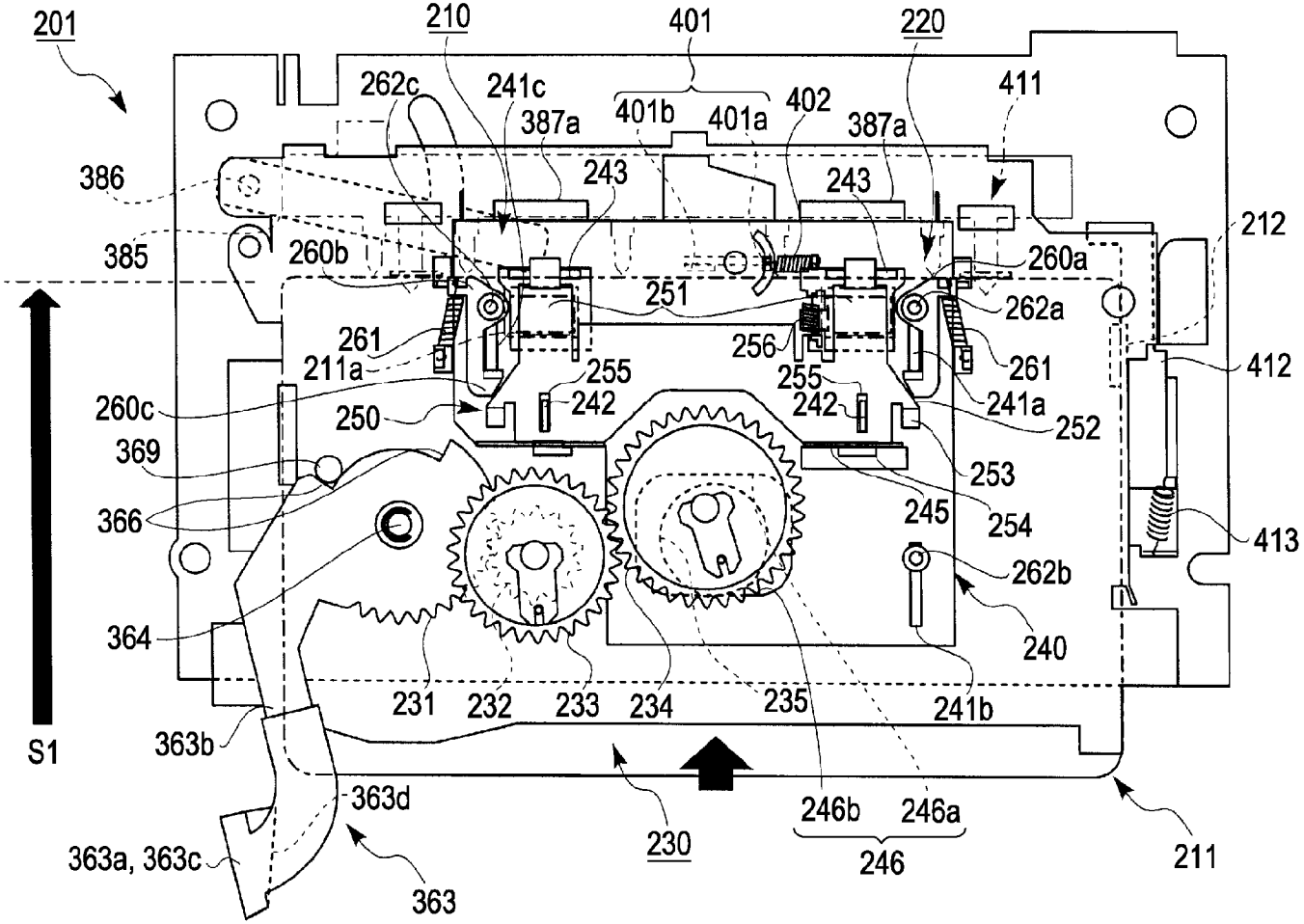
FIG. 8 is a plan view of the attachment/detachment device in a state where the lever is in the reset position when the ink cartridge is completely inserted.
Figure 9:
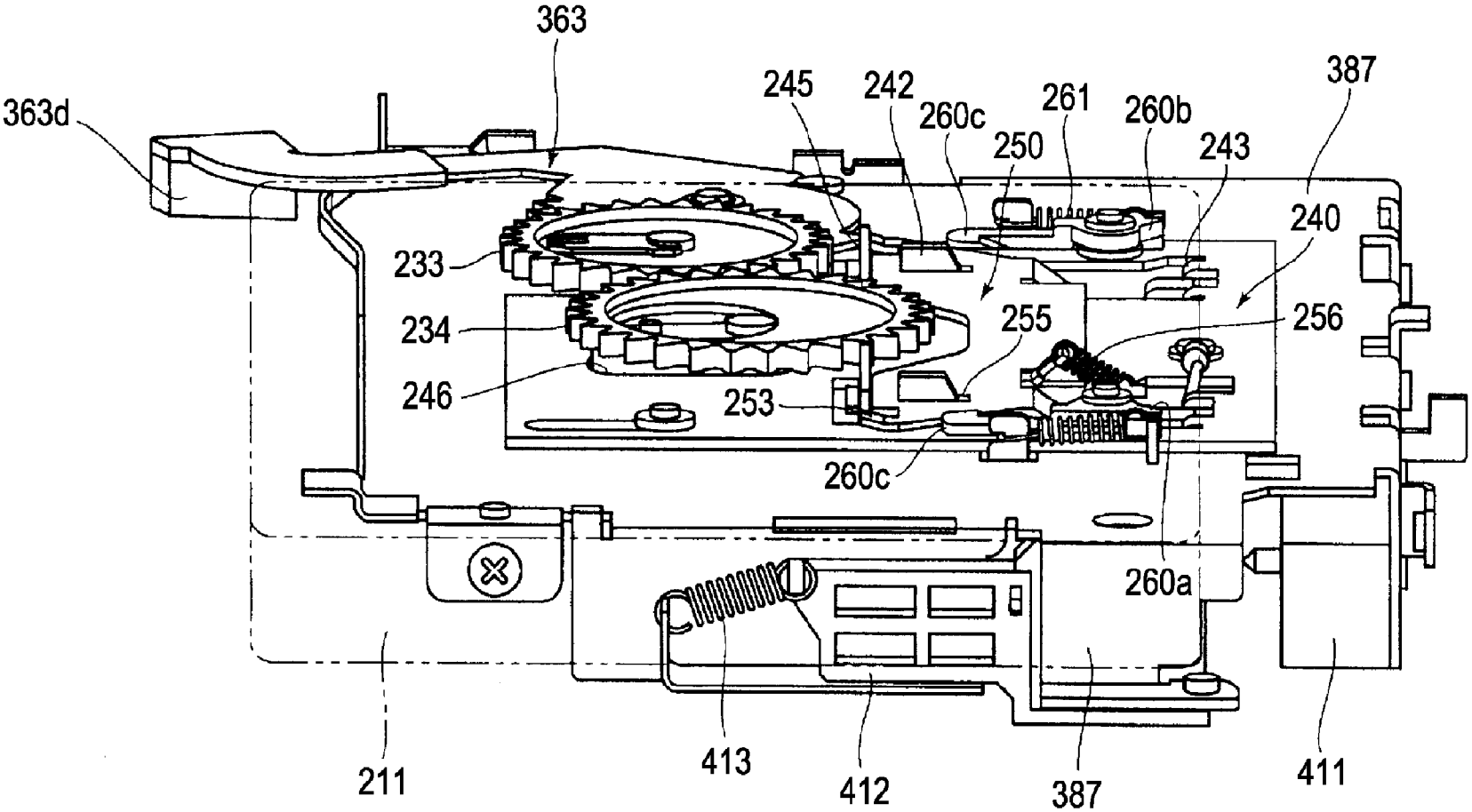
FIG. 9 is a side perspective view of the attachment/detachment device in a state where the lever in the reset position when the ink cartridge is completely inserted.
Figure 10:
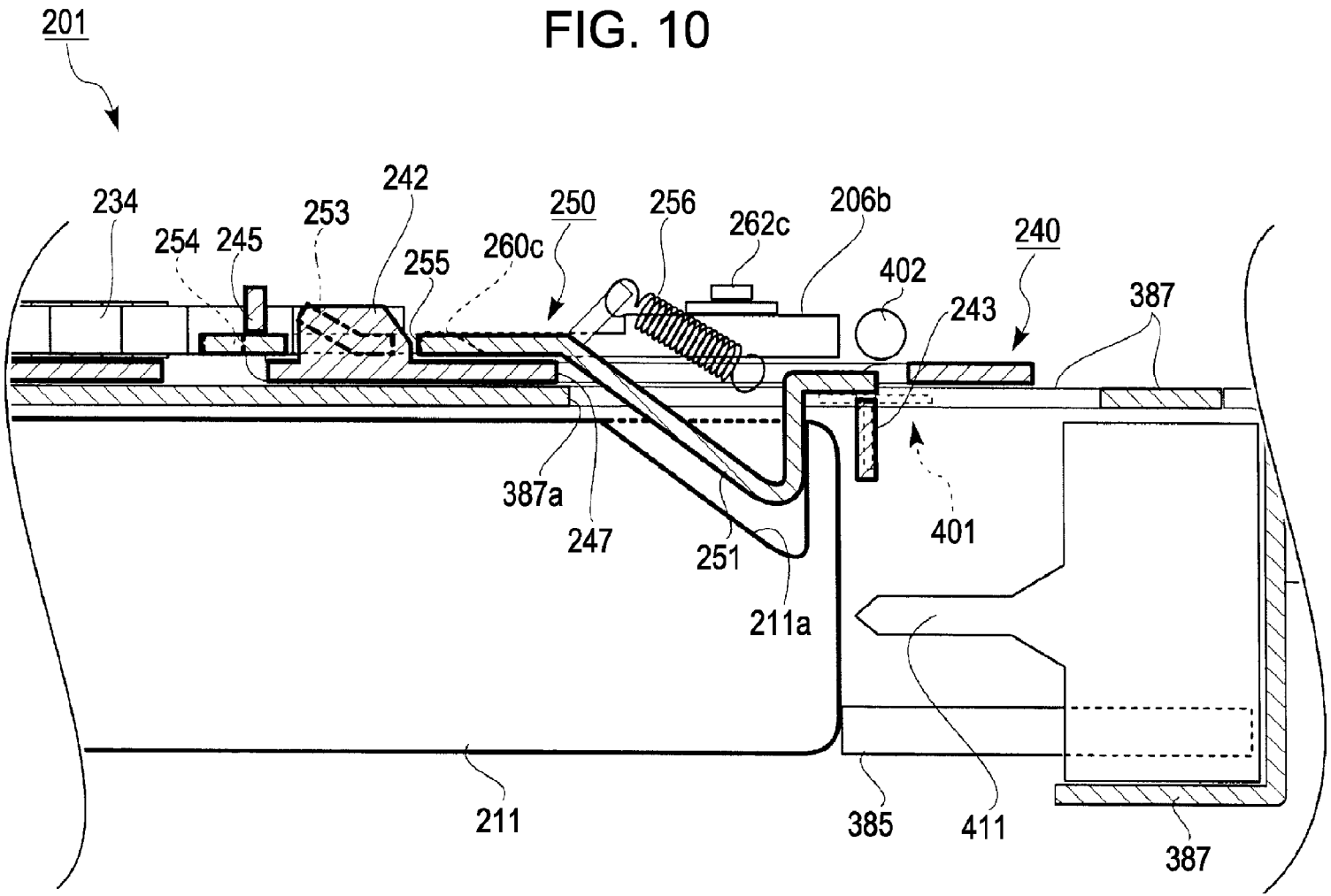
FIG. 10 is a side cross-sectional view of a relevant part of the attachment/detachment device in a state where the lever is in the reset position when the ink cartridge is completely inserted.

FIG. 8 is a plan view of the attachment/detachment device when the ink cartridge is completely inserted and the lever arm is in the reset position. FIG. 9 is a side perspective view of FIG. 8. FIG. 10 is a side cross-sectional view of a relevant part of FIG. 8. As the ink cartridge 211 is further pushed in from a state shown in FIGS. 5 to 7 by the first predetermined stroke S1 against the urging force of the first ejection lever 385, the ink cartridge 211 is completely inserted as shown in FIGS. 8 to 10.

Specifically, as the ink cartridge 211 is further pushed in from a state shown in FIGS. 5 to 7, the distal end portion of the ink cartridge 211 contacts with the pawl portions 251 of the latch plate 250, extending downward through the second slider opening 247 of the slider portion 240. Then, the distal end portion of the ink cartridge 211 lifts the pawl portions 251 upward against the urging force of the latch plate spring 256, so that the two pawl portions 251 engage with the two recesses 211*a* of the ink cartridge 211. That is, the slider portion 240 integrally holds the ink cartridge 211 through the latch plate 250. Then, this state is a state where the ink cartridge 211 is completely inserted.

Note that the two pawl portions 251 of the latch plate 250 are formed integrally with the latch plate 250. The two pawl portions 251 of the latch plate 250 are configured so as to engage with two recesses 211*a* that are provided at substantially the middle portion in the width direction relative to the loading direction of the ink cartridge 211. Thus, even when the ink cartridge 211 is inclined a certain angle relative to the loading direction, it is possible for the two pawl portions 251 to engage with the two corresponding recesses 211*a*. Further, the two pawl portions 251 are moved synchronously with each other because they are formed integrally with the latch plate 250. Therefore, it is unlikely to enter a so-called single latched state, that is, one of the pawl portions 251 is engaged with the recess 211*a* and the other is not engaged with the recess 211*a*.

In addition, even when the ink cartridge 211 is further pushed in from the position of the ink cartridge 211 shown in FIGS. 8 to 10 toward the back, the distal end of the ink cartridge 211 is restricted by the stop portion 243, which is provided on the slider portion 240. Then, the slider portion 240 is immovable unless the lever arm 363 is pivoted by the concentric cam portion of the above-mentioned cam portion 235.

Loading of Ink Cartridge

Figure 11:
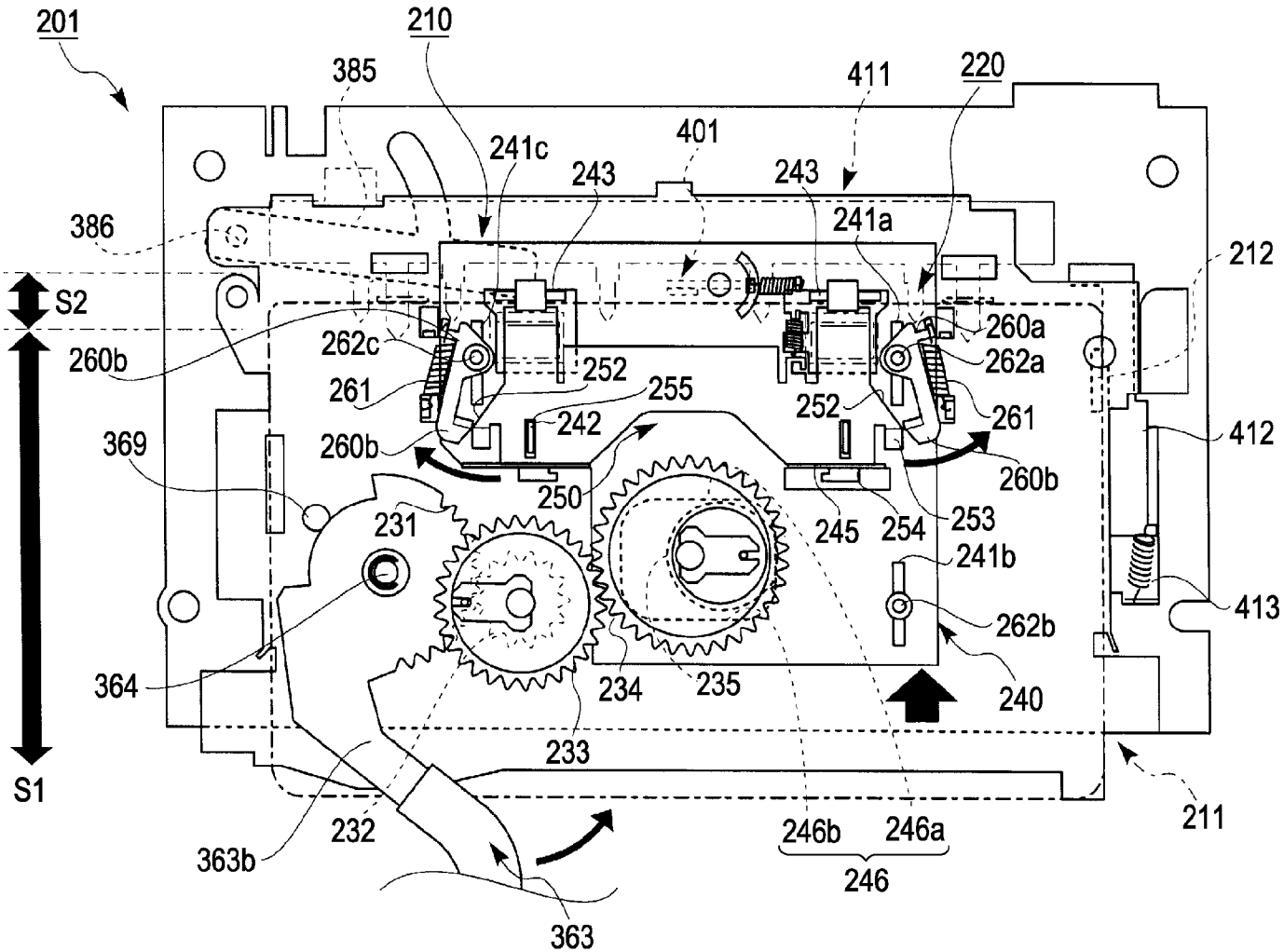
FIG. 11 is a plan view of the attachment/detachment device when the ink cartridge is being loaded.
Figure 12:
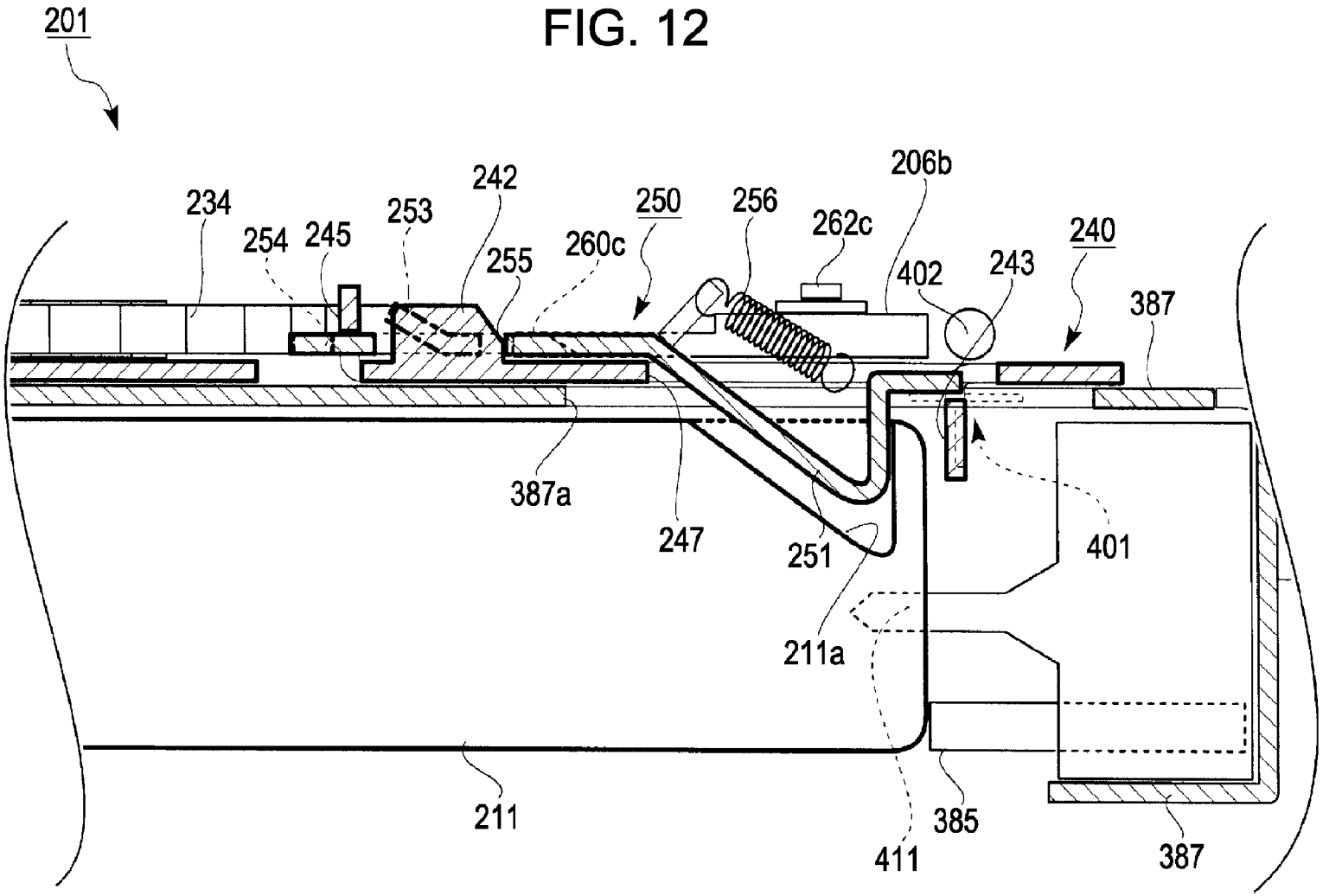
FIG. 12 is a side cross-sectional view of a relevant part of the attachment/detachment device when the ink cartridge is being loaded.

FIG. 11 is a plan view of the attachment/detachment device when the ink cartridge is being loaded. FIG. 12 is a side cross-sectional view of a relevant part of FIG. 11. As shown in FIG. 11, as the lever arm 363 is pivoted about the lever pivot shaft 364 from the reset position shown in FIG. 8 in a counterclockwise direction, the first gear 231 transmits power to the second gear 232, and the third gear 233, formed integrally with the second gear 232, transmits power to the fourth gear 234. The cam portion 235, which is formed integrally with the fourth gear 234, contacts and presses the first surface 246*a* of the first slider opening 246 to move the slider portion 240 in the loading direction. The slider portion 240 is provided with two guide slits 241*a*, 241*b* in series along the loading direction. Then, the shafts 262*a*, 262*b*, which are provided on the base portion 387, are inserted through the guide slits 241*a*, 241*b*. Hence, the moving direction of the slider portion 240 is restricted.

The cam portion 235 is configured to press the middle portion in the width direction relative to the loading direction of the slider portion 240. In addition, in regard to the positional relationship between the cam portion 235 and the latch plate 250, in the width direction the cam portion 235 presses the slider portion 240 at a position that is located on the substantially center line between the two pawl portions 251 of the latch plate 250. Further, as shown in FIG. 12, the surfaces of the pawl portions 251 that press the ink cartridge 211 are oriented perpendicular to the loading direction. Accordingly, it is possible to stabilize the attitudes of the ink cartridge 211, the latch plate 250 and the slider portion 240, while efficiently transmitting power of the cam portion 235 to the ink cartridge 211.

As the slider portion 240 is moved in the loading direction, the ink cartridge 211 that is held by the pawl portions 251 of the latch plate 250 is also moved together. Then, due to the own weight of the ink cartridge 211, the engagement between the slider engaging portions 245 and the latch plate engaging portions 254, which are first engaging devices, is loosened. In the second engaging devices, each of the slider protrusions 242 that engage with the latch plate slits 255 presses the surface of the latch plate slit 255 on the side in the loading direction. This pressing force moves the ink cartridge 211 in the loading direction through the pawl portions 251. As the ink cartridge 211 is moved, the ink supply needle 411 provided adjacent to the distal end of the ink cartridge 211 in the loading direction is gradually stuck into the ink cartridge 211.

At this time, a large pressing force is required to stick the ink supply needle 411 into the ink cartridge 211. Because the slider protrusions 242 are formed by bending so as to extend in a direction perpendicular to the above mentioned loading direction, it is unlikely to be deflected or deformed even when a large force is applied thereto. That is, it is possible for the slider protrusions 242 to reliably transmit pressing force through the latch plate 250 to the ink cartridge 211 by being in surface contact with the surfaces of the latch plate slits 255 in the loading direction. Further, because the slider protrusions 242 are hardly deformed, it is possible to position the latch plate 250 accurately, that is, so-called rigidly.

Such a configuration that the latch plate 250 is engaged with the slider portion 240 by means of the first engaging devices and the second engaging devices is employed. This is because, if a fulcrum shaft is provided for swinging the latch plate 250, a large pressing force required for loading the ink cartridge 211 concentrates on the fulcrum shaft and, as a result, the fulcrum shaft may be deformed, thus making it difficult to ensure the accuracy of pressing force and the accuracy of distance to be pressed when the ink cartridge 211 is pushed in. Without the fulcrum shaft, it is possible to reliably ensure the force and distance (the second predetermined stroke S2) to be pressed by changing the engaging portion depending on the movement of the latch plate 250, while the latch plate 250 remains swingable.

Furthermore, the slider engaging portions 245 and the latch plate engaging portions 254, which serve as the first engaging devices, and the slider protrusions 242 and the latch plate slits 255, which serve as the second engaging devices, are provided in the loading direction in series with the pawl portions 251. Owing to this arrangement, it is possible to further accurately and rigidly position the pawl portions 251 of the latch plate 250. In addition, because a pair of the first engaging devices and a pair of the second engaging devices each are provided in the width direction relative to the loading direction, it is possible to stabilize the attitude of the latch plate 250. Moreover, because the second engaging devices are provided in the loading direction in series with the corresponding pawl portions 251, it is possible to further efficiently transmit pressing force to the pawl portions 251.

In addition, the slider protrusions 242 and the latch plate slits 255, serving as the second engaging devices, restrict the position of the latch plate 250 in the width direction relative to the slider portion 240. Accordingly, when the ink cartridge 211 is inserted, it is possible to reliably engage the recesses 211*a* of the ink cartridge 211 with the pawl portions 251 of the latch plate 250 in opposite positions.

In regard to the positions where the pawl portions 251 engage with the recesses 211*a*, the attitude of the ink cartridge 211 is more stabilized the closer the ink cartridge 211 is to the position where the ink supply needle 411 is stuck into the ink cartridge 211 in the vertical direction of the ink cartridge 211 (in the vertical direction in FIG. 12). In addition, it is possible to efficiently transmit pressing force, which is the power of the cam portion 235 upon loading, to the ink cartridge 211. In addition to the relationship with the loci of the lower distal ends of the pawl portions 251 when the latch plate 250 is lifted upward upon ejection, which will be described later, the engaging positions between the pawl portions 251 and the recesses 211*a* are desirably configured so that the engaging positions are opposite the ink supply needle 411 in the vertical direction of the ink cartridge 211.

Next, as the lever arm 363 is pivoted to the set position, the slider portion 240 is moved in the loading direction. In accordance with this movement of the slider portion 240, shoulder portions 252 contact the distal end contact portion 260*c* of the cancel arms 260*a*, 260*b* to pivot the cancel arms 260*a*, 260*b* about the shaft 262*c*, which is inserted through the guide slit 241*c*, and the shaft 262*a*, which is inserted through the guide slit 241*a*, against the urging force of the cancel arm springs 261 (see FIG. 11). At this time, because the shoulder portions 252 receive pressing force from the distal end contact portions 260*c*, it is possible for the slider protrusions 242 to reliably contact the surfaces of the latch plate slits 255 in the loading direction. That is, it is possible to stabilize the attitude of the latch plate 250 by the urging force of the cancel arm springs 261.

Further, as the slider portion 240 moves in the loading direction and the shoulder portions 252 pass over the distal end contact portions 260*c* of the cancel arms 260*a*, 260*b*, the cancel arms 260*a*, 260*b* are returned to the original states (see FIGS. 5, 8, and 14) by the urging force of the cancel arm springs 261. Because the cancel arms 260*a*, 260*b* work on the latch plate 250 when the ink cartridge 211 is ejected, the cancel arms 260*a*, 260*b* will be described when the ejection of the ink cartridge is described. Then, as the lever arm 363 is manipulated by being pivoted in the counterclockwise direction to the set position, the ink cartridge 211 is completely loaded.

Figure 13:
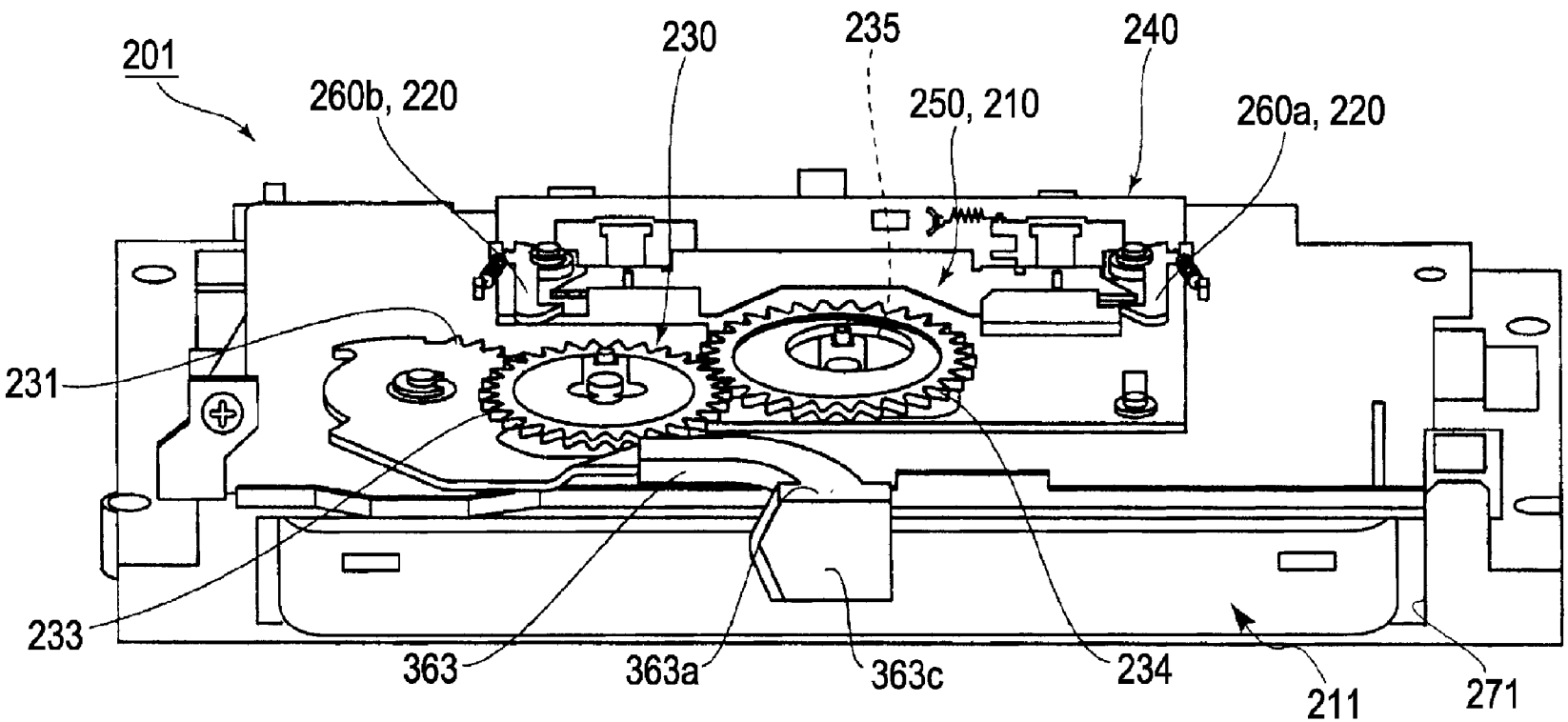
FIG. 13 is a front perspective view of the attachment/detachment device in a state where the lever is in a set position when the ink cartridge is completely loaded.
Figure 14:
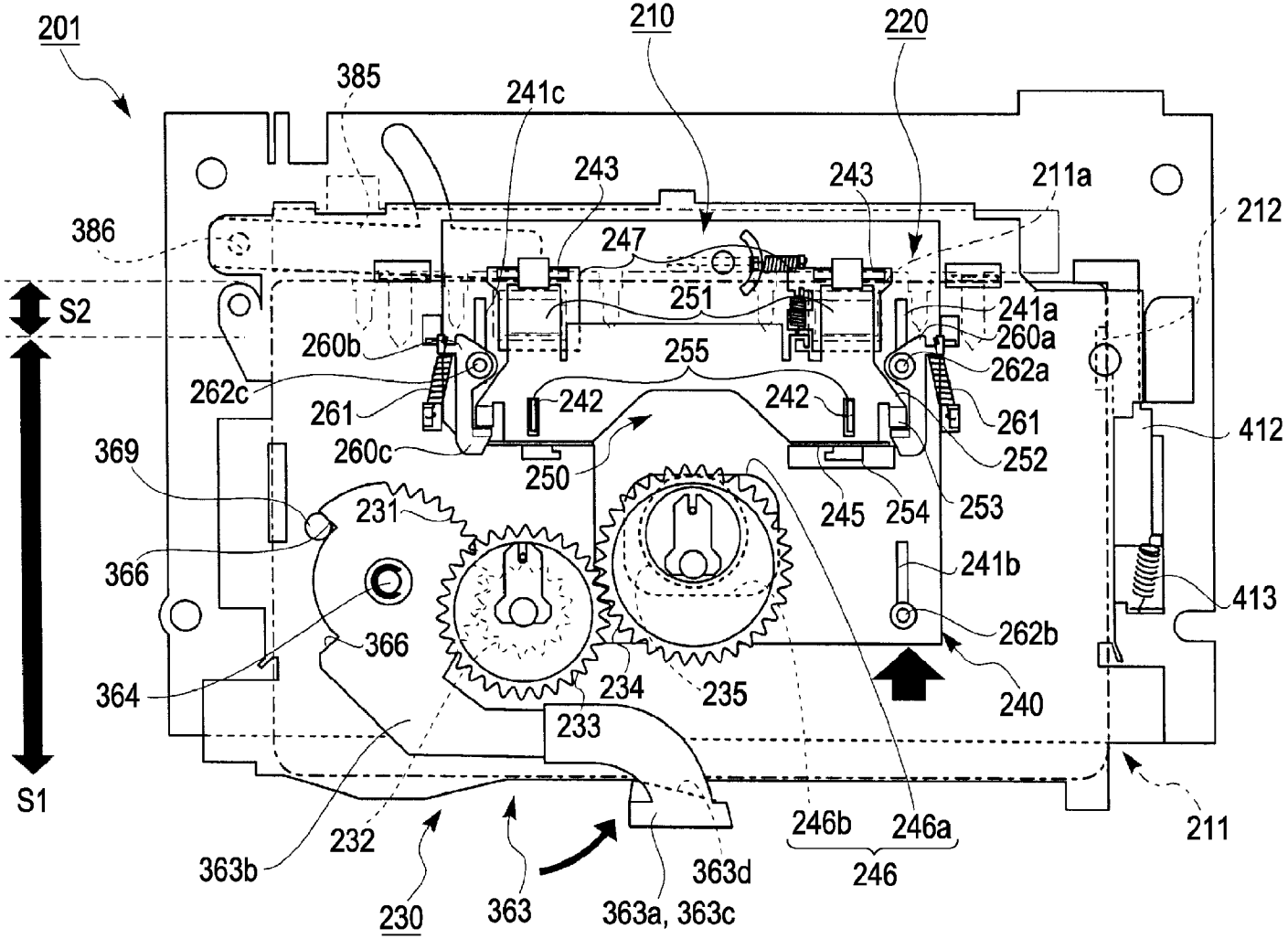
FIG. 14 is a plan view of the attachment/detachment device in a state where the lever is in the set position when the ink cartridge is completely loaded.
Figure 15:
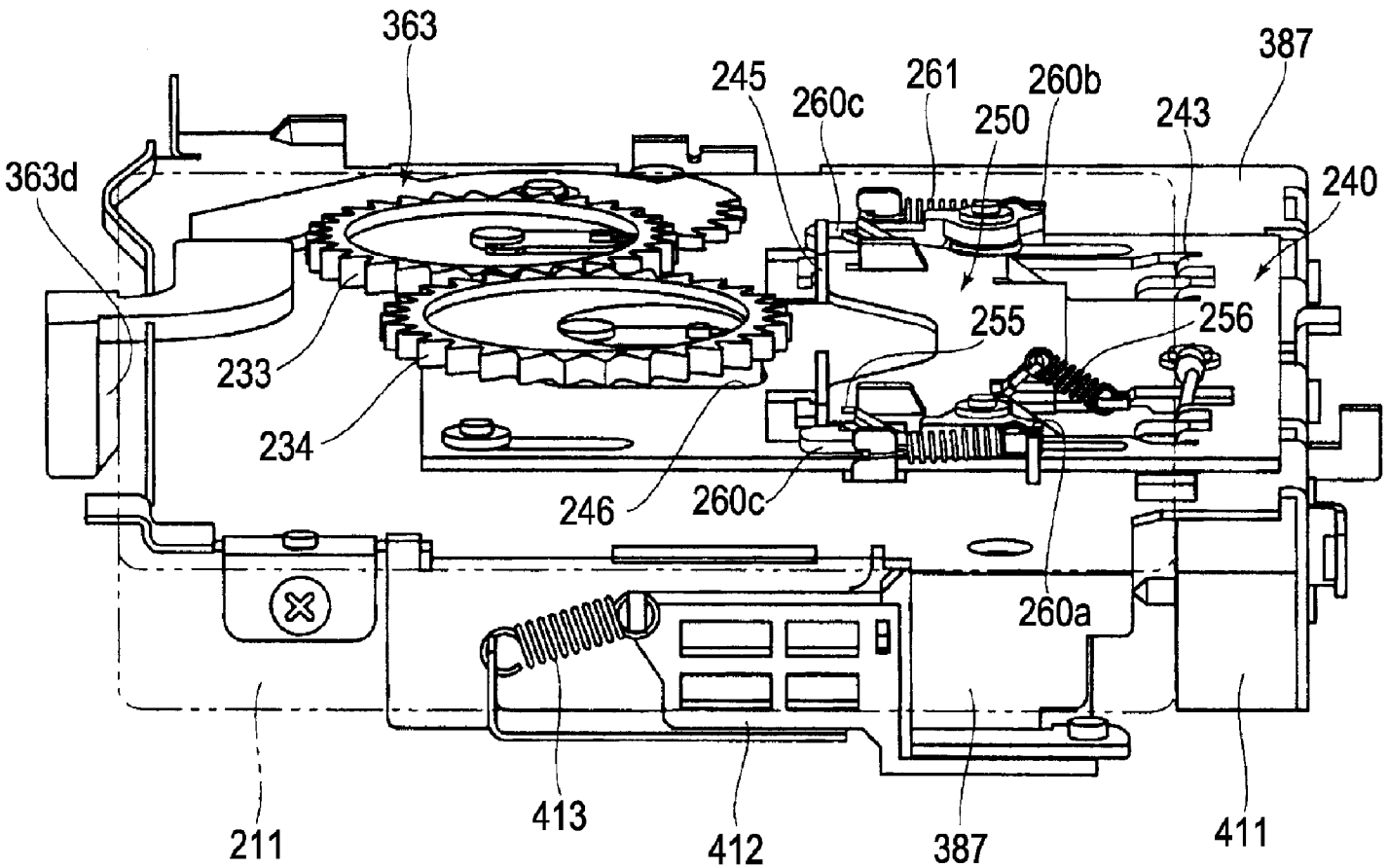
FIG. 15 is a side perspective view of the attachment/detachment device in a state where the lever is in the set position when the ink cartridge is completely loaded.
Figure 16:
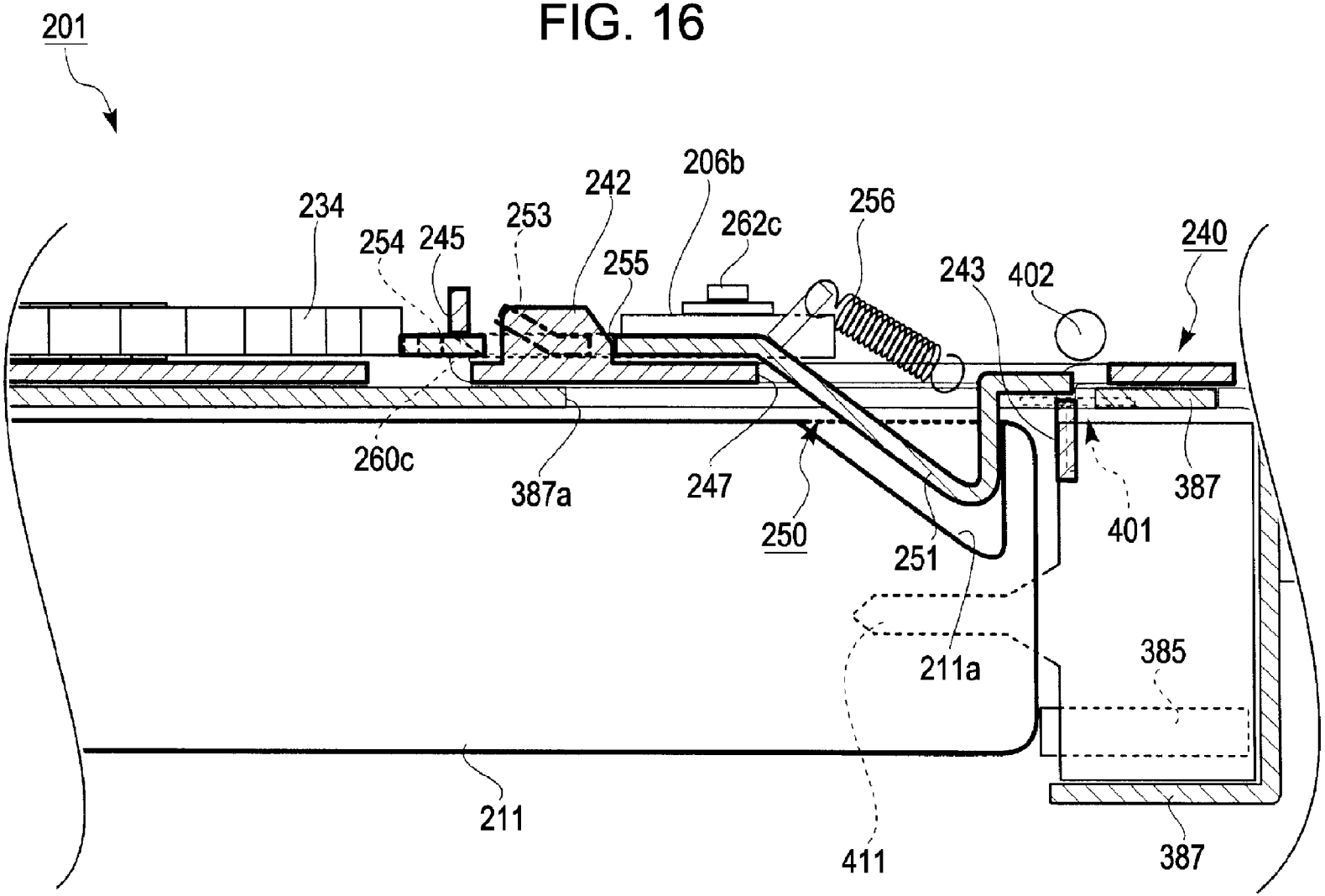
FIG. 16 is a side cross-sectional view of a relevant part of the attachment/detachment device in a state where the lever is in the set position when the ink cartridge is completely loaded.

FIG. 13 is a front perspective view of the attachment/detachment device when the ink cartridge is completely loaded and the lever arm is in the set position. FIG. 14 is a plan view of FIG. 13. FIG. 15 is a side perspective view of FIG. 13. FIG. 16 is a side cross-sectional view of a relevant part of FIG. 13. As shown in FIGS. 13 to 16, as the lever arm 363 is further pivoted from a state shown in FIGS. 11 and 12 to the set position, the ink cartridge 211 is moved from a state where the ink cartridge 211 is completely inserted (see FIGS. 8 to 10) in the loading direction by the second predetermined stroke S2 to a state where the ink supply needle 411 is completely stuck into the ink cartridge 211, that is, a state where the ink cartridge 211 is completely loaded.

In addition, an ink residual amount information terminal 212 is provided on the front of the right side face of the ink cartridge 211 and is configured to be electrically connected to a connector portion 412 that is provided on the main body of the attachment/detachment device immediately before the loading of the ink cartridge 211 is completed. The connector portion 412 is movable by a certain distance in the loading direction and is able to follow the movement of the ink cartridge 211 by a little stroke from the point just before the loading of the ink cartridge 211 is completed to the point where the loading of the ink cartridge is completed by means of a contact surface of the connector portion 412, formed at the distal end side thereof, that contacts the side face of the distal end of the ink cartridge 211, and a connector spring 413. Note that, when the connector portion 412 is electrically connected to the ink residual amount information terminal 212 or when the connection is released, there occurs a friction between the connector portion 412 and the ink cartridge 211.

Furthermore, immediately before the loading of the ink cartridge 211 is completed, the distal end side of the ink cartridge 211 contacts a valve lever (not shown) that switches open/close of an ink passage valve (not shown) formed in the main body of the attachment/detachment device. The valve lever is configured so as to urge the ink cartridge 211 in the ejecting direction by means of a spring (not shown) as in the case of the first ejection lever 385. When the distal end side of the ink cartridge 211 is not in contact with the valve lever, the ink passage valve will be closed. On the other hand, when the loading of the ink cartridge 211 is completed, as the distal end side of the ink cartridge 211 contacts the valve lever to move the valve lever against the urging force, the ink passage valve will be opened.

Ejection of Ink Cartridge

Figure 17:
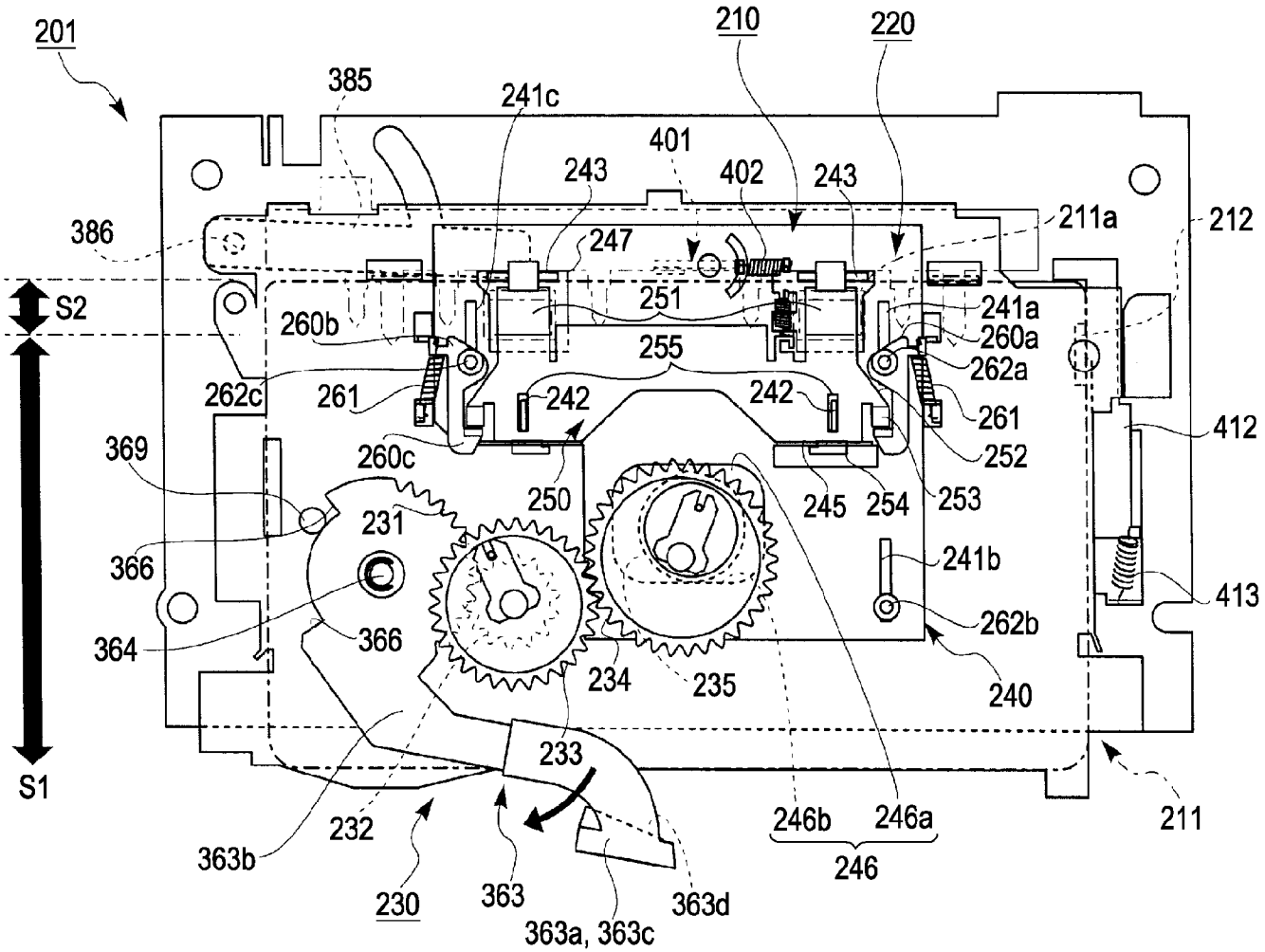
FIG. 17 is a plan view of the attachment/detachment device when the ink cartridge is being ejected.
Figure 18:
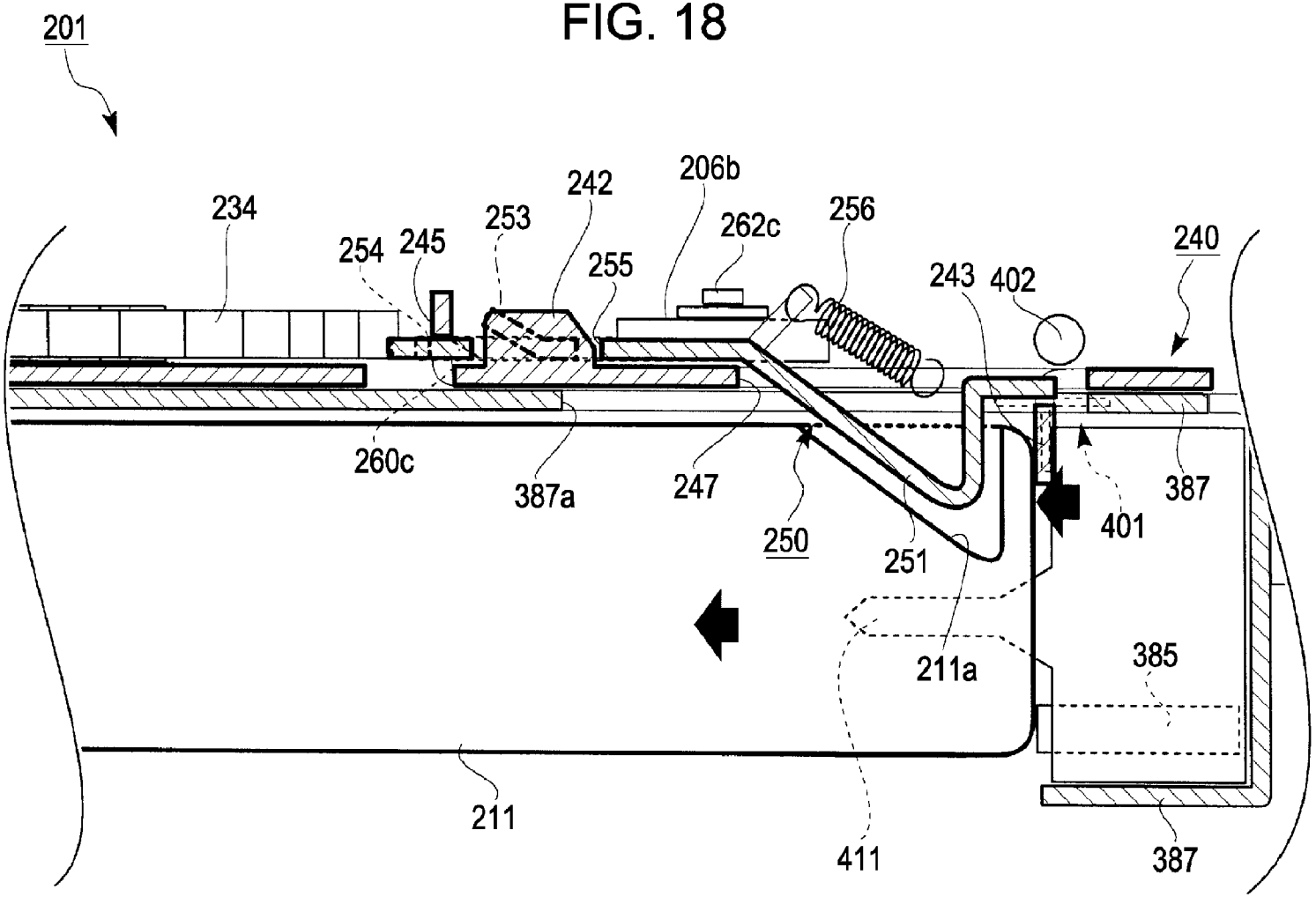
FIG. 18 is a side cross-sectional view of a relevant part of the attachment/detachment device when the ink cartridge is being ejected.

FIG. 17 is a plan view of the attachment/detachment device when the ink cartridge is being ejected. FIG. 18 is a side cross-sectional view of a relevant part of FIG. 17. When the ink cartridge 211 is ejected, the lever arm 363 is pivoted from the set position shown in FIG. 13 to the reset position shown in FIGS. 5 and 8 in the clockwise direction. The movement of the attachment/detachment device 201 is complicated, so a description will be given separately for each stage.

As shown in FIGS. 17 and 18, as the lever arm 363 is pivoted slightly from the set position toward the reset position, power of the pivotal movement of the lever arm 363 is transmitted to the cam portion 235 as described above. The cam portion 235 contacts and presses the second surface 246*b* of the first slider opening 246, which is formed in the slider portion 240, to move the slider portion 240 slightly in the ejecting direction. Then, because the ink supply needle 411 is stuck into the ink cartridge 211, the ink cartridge 211 does not initiate to move until it contacts the stop portions 243, which are provided on the distal end side of the slider portion 240 in the loading direction (see FIG. 18).

As the slider portion 240 moves slightly in the ejecting direction, the latch plate 250 also moves slightly in the ejecting direction. In this case, the engagement between the pawl portions 251 of the latch plate 250 and the recesses 211*a* of the ink cartridge 211 is loosened, and gaps, or so-called clearances, are then formed between the pawl portions 251 and the recesses 211*a*. Thus, the pawl portions 251 are in a state where no force is applied from the ink cartridge 211. Thereafter, because the latch plate spring 256 works on the latch plate 250, the distal end side of the latch plate slit 255 in the loading direction and the slider protrusion 242, which have been brought into contact with each other while loading, are separated from each other. Then the latch plate 250 engages with the slider portion 240 by means of the first engaging devices. Note that, because the urging force of the first ejection lever 385 is smaller than the frictional force generated between the ink cartridge 211 and the ink supply needle 411, the ink cartridge 211 does not move.

Figure 19:
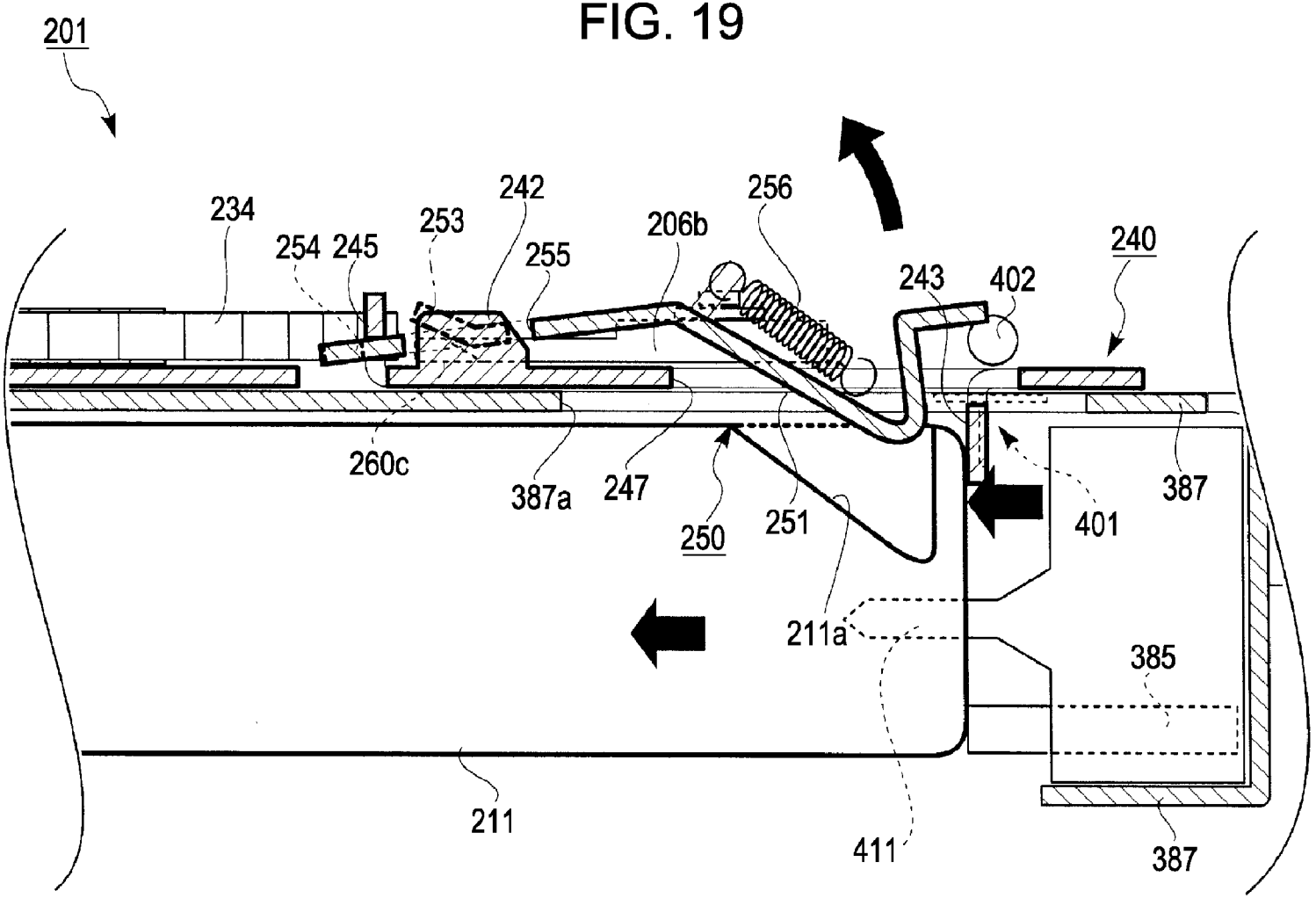
FIG. 19 is a side cross-sectional view of a relevant part of the attachment/detachment device when the ink cartridge is being ejected (a latch plate is raised).

FIG. 19 is a side cross-sectional view of a relevant part of the attachment/detachment device when the ink cartridge is being ejected. As shown in FIG. 19, as the lever arm 363 is gradually pivoted further from a state shown in FIGS. 17 and 18 toward the reset position, the slider portion 240 is gradually moved further to the left side in the drawing, that is, in the ejecting direction. At this time, the stop portions 243 provided in the slider portion 240 contact and press the distal end portion of the ink cartridge 211. Accordingly, the stop portions 243 gradually compel the ink cartridge 211 to move to the left side in the drawing, that is, in the ejecting direction, against the frictional force generated between the ink cartridge 211 and the ink supply needle 411. Then, the stop portions 243 are provided at positions opposite the two pawl portions 251. As well as the pawl portions 251 push in the ink cartridge 211 while stabilizing the attitude of the ink cartridge 211 when the ink cartridge 211 is loaded, it is possible for the two stop portions 243 to move the ink cartridge 211 in the ejecting direction while stabilizing the attitude of the ink cartridge 211 when the ink cartridge 211 is ejected.

In addition, as the slider portion 240 moves in the ejecting direction, the pair of slope portions 253 of the latch plate 250 gradually run onto the distal end contact portions 260*c* of the cancel arms 260*a*, 260*b*. At this time, the distal end contact portions 260*c* urge the latch plate 250 through the slope portions 253 so that the latch plate 250 is engaged with the first engaging devices, and lift the latch plate 250 upward through the slope portions 253. Thereafter, the latch plate 250 begins to lift upward about the position where the slider engaging portions 245 and the latch plate engaging portions 254, which are the first engaging devices, engage with each other.

Then, because the pawl portions 251 extend downward, the radii of the loci of the lower distal ends of the pawl portions 251 are larger than those of the other portions; however, owing to the gaps between the pawl portions 251 and the recesses 211*a*, the pawl portions 251 are able to lift up without receiving any frictional resistance. Here, the gaps are very small intervals but, because the first engaging devices are in surface contact and the positions and loci of the pawl portions 251 may be set rigidly, it is unlikely to generate a friction between the pawl portions 251 and the recesses 211*a* when the latch plate 250 lifts upward.

Figure 20:
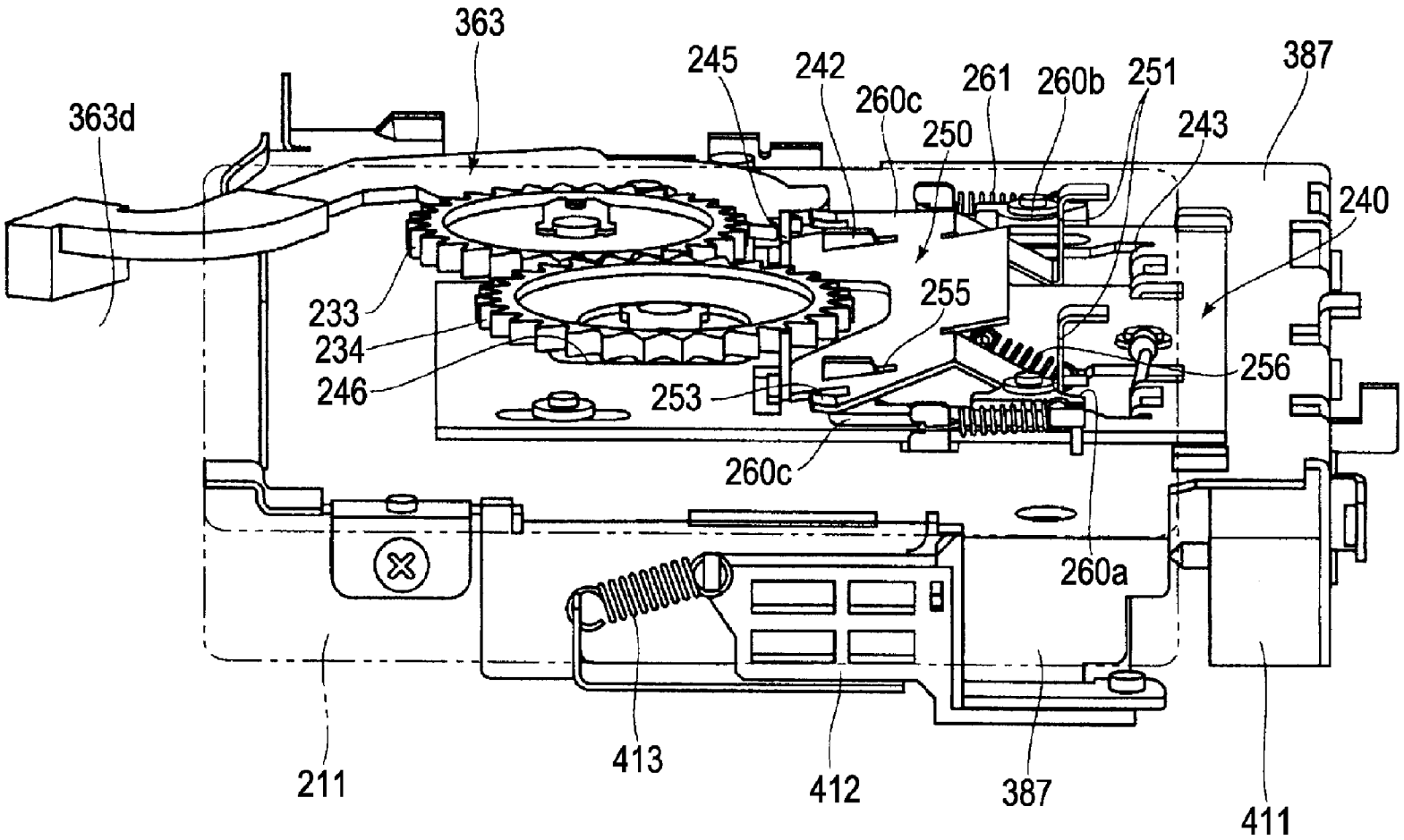
FIG. 20 is a side perspective view of the attachment/detachment device when the ink cartridge is being ejected (forcibly pushed out).
Figure 21:
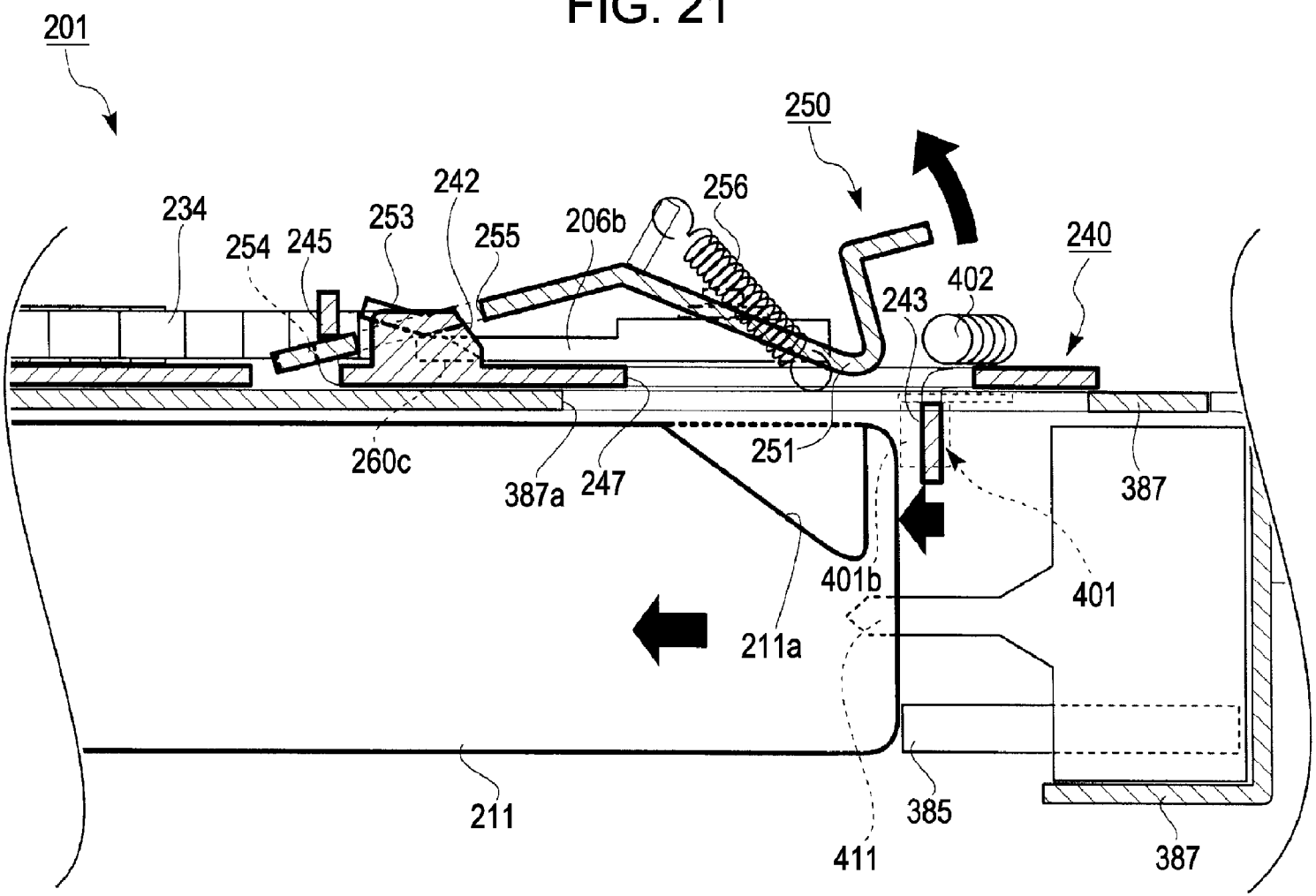
FIG. 21 is a side cross-sectional view of a relevant part of the attachment/detachment device when the ink cartridge is being ejected (forcibly pushed out).

FIG. 20 is a side perspective view of the attachment/detachment device when the ink cartridge is being ejected. FIG. 21 is a side cross-sectional view of a relevant part of FIG. 20. As shown in FIGS. 20 and 21, as the lever arm 363 is gradually pivoted further from a state shown in FIG. 19 toward the reset position, the slider portion 240 is gradually moved further in the ejecting direction. At this time, the slope portions 253 of the latch plate 250 completely run on the distal end contact portions 260*c* of the cancel arms 260*a*, 260*b*. Thus, the latch plate 250 is lifted upward to reach the highest point, and the pawl portions 251 completely come out of the recesses 211*a*, thus becoming a state where the engagement is released. Here, because the upward lift of the latch plate 250 needs gaps between the pawl portions 251 and the recesses 211*a*, the latch plate 250 is lifted upward during times when the stop portions 243 allow the ink cartridge 211 to move in the ejecting direction.

On the other hand, the stop portions 243 continue to move the ink cartridge 211 in the ejecting direction until the ink supply needle 411 almost completely comes out of the ink cartridge 211 so that a relatively large frictional resistance is eliminated between the ink cartridge 211 and the ink supply needle 411. After the frictional resistance is eliminated between the ink cartridge 211 and the ink supply needle 411, a push-out lever 401, which is provided on the slider portion 240, works to forcibly move the ink cartridge 211 in the ejecting direction relative to the slider portion 240, which forms the cartridge holder 210. The push-out lever 401 is configured so as to move the ink cartridge 211 against a relatively small frictional resistance between the ink cartridge 211 and the connector portion 412.

Figure 22:
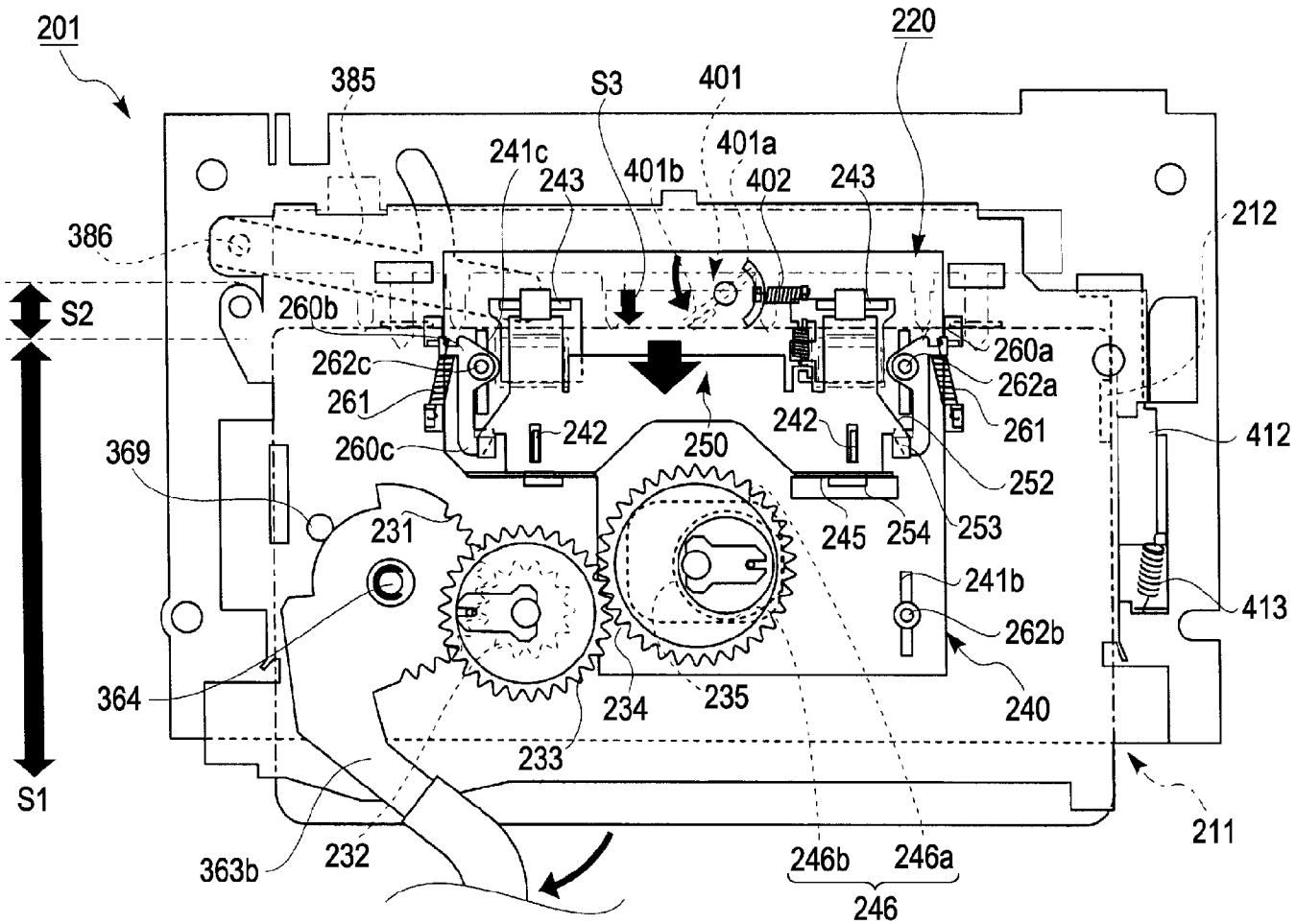
FIG. 22 is a plan view of the attachment/detachment device when the ink cartridge is being ejected (pushed out by urging force of a spring).

Here, the push-out lever 401 includes a push portion 401*b* (see FIG. 22) and a contact portion 401*a* (see FIG. 22). The push portion 401*b* (see FIG. 22) contacts the ink cartridge 211 at one end to push out the ink cartridge 211. The contact portion 401*a* (see FIG. 22) contacts and engages at the other end with a protrusion (not shown) which is formed on the base portion 387 of the attachment/detachment device 201. The push-out lever 401 is pivotable on the supporting point of the slider portion 240. Then, when the engagement between the protrusion (not shown) and the contact portion 401*a* is released, the pivoted push-out lever 401 returns to the original position (the position shown in FIG. 17) by the function of the push lever spring 402. In regard to the actual movement, as the slider portion 240 is moved in the ejecting direction, the contact portion 401*a* of the push-out lever 401 that moves together with the slider portion 240 engages with the protrusion of the base portion 387 (not shown) to pivot the push-out lever 401 using the contact portion 401*a* as the operating point on the basis of leverage principle. Then, the push portion 401*b* becomes the action point on the leverage principle to forcibly move the ink cartridge 211 in the ejecting direction relative to the slider portion 240 by a third predetermined stroke S3 (see FIGS. 22 and 23).

At this time, because the push-out lever 401 moves the ink cartridge 211 in the ejecting direction relative to the slider portion 240 by the third predetermined stroke S3, it is unlikely to engage the pawl portions 251 with the recesses 211*a* by a so-called erroneous manipulation (abnormal manipulation) to pivot the lever arm 363 to the set position in reverse even when the latch plate 250 is lowered downward. Here, the third predetermined stroke S3 means a distance that the ink cartridge 211 moves relative to the slider portion 240 from the position where the pawl portions 251 engage with the recesses 211*a* to the position where the pawl portions 251 are not engaged with the recesses 211*a*.

Note that in FIG. 21, it seems that the ink supply needle 411 remains stuck into the ink cartridge 211; however, it shows a state where the ink supply needle 411 has already come out of a packing (not shown) fitted in an opening of the ink cartridge through which the ink supply needle 411 is inserted and no frictional resistance exists between the ink cartridge 211 and the ink supply needle 411. In addition, in this embodiment, the push-out lever 401 is configured to work against a relatively small frictional resistance between the ink cartridge 211 and the connector portion 412. However, of course, the push-out lever 401 may be configured to work against a relatively large frictional resistance between the ink cartridge 211 and the ink supply needle 411.

Figure 23:
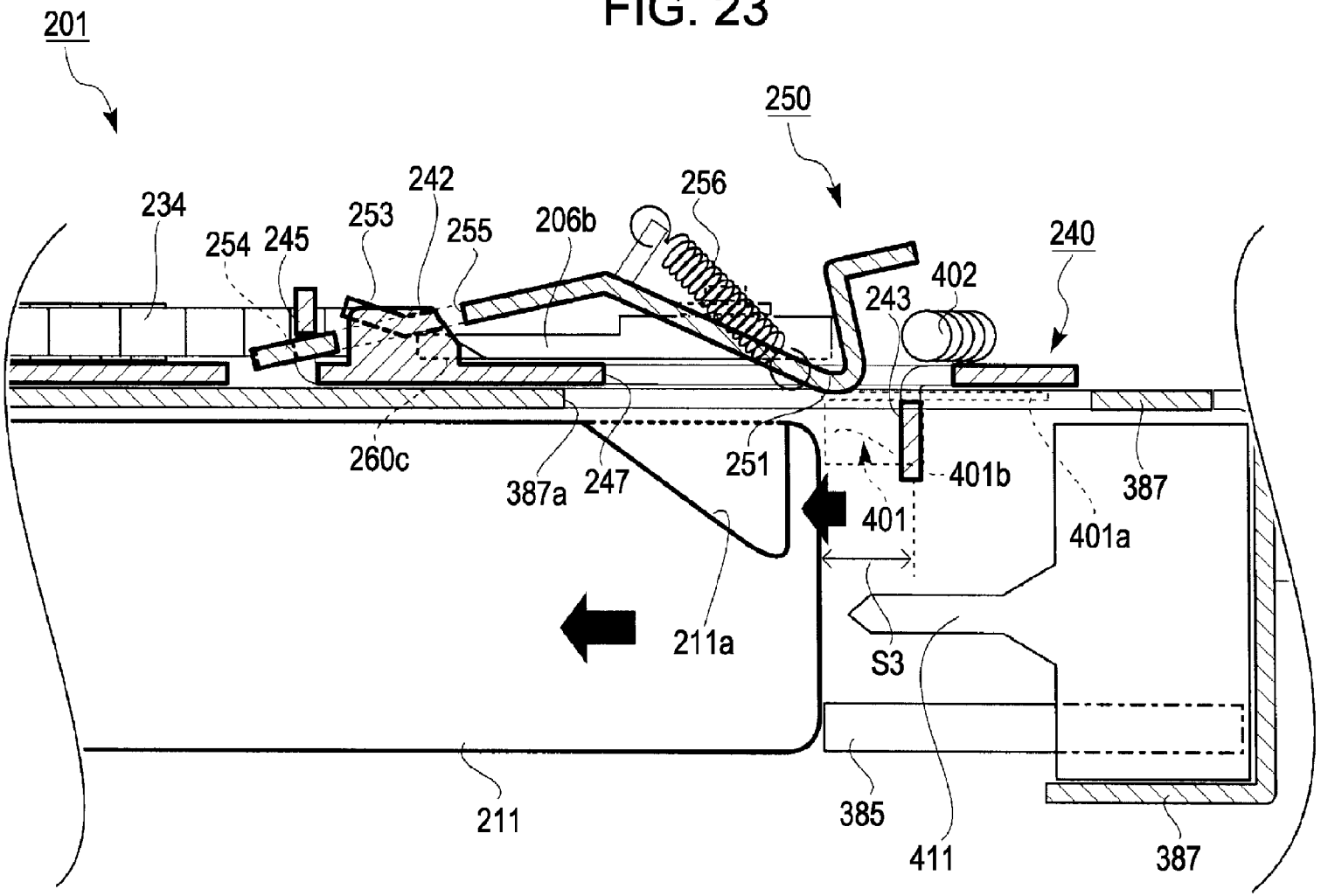
FIG. 23 is a side cross-sectional view of a relevant part of the attachment/detachment device when the ink cartridge is being ejected (pushed out by urging force of the spring).

FIG. 22 is a plan view of the attachment/detachment device when the ink cartridge is being ejected. FIG. 23 is a side cross-sectional view of a relevant part of FIG. 22. As shown in FIGS. 22 and 23, as the lever arm 363 is gradually pivoted further from a state shown in FIGS. 20 and 21 toward the reset position, the slider portion 240 is gradually moved further in the ejecting direction. After the push-out lever 401 moves the ink cartridge 211 relative to the slider portion 240 against a relatively small frictional resistance between the ink cartridge 211 and the connector portion 412, almost no frictional resistance exists between the ink cartridge 211 and the attachment/detachment device 201. Thus, the first ejection lever 385 exactly tries to push out the ink cartridge 211 by its urging force.

Figure 24:
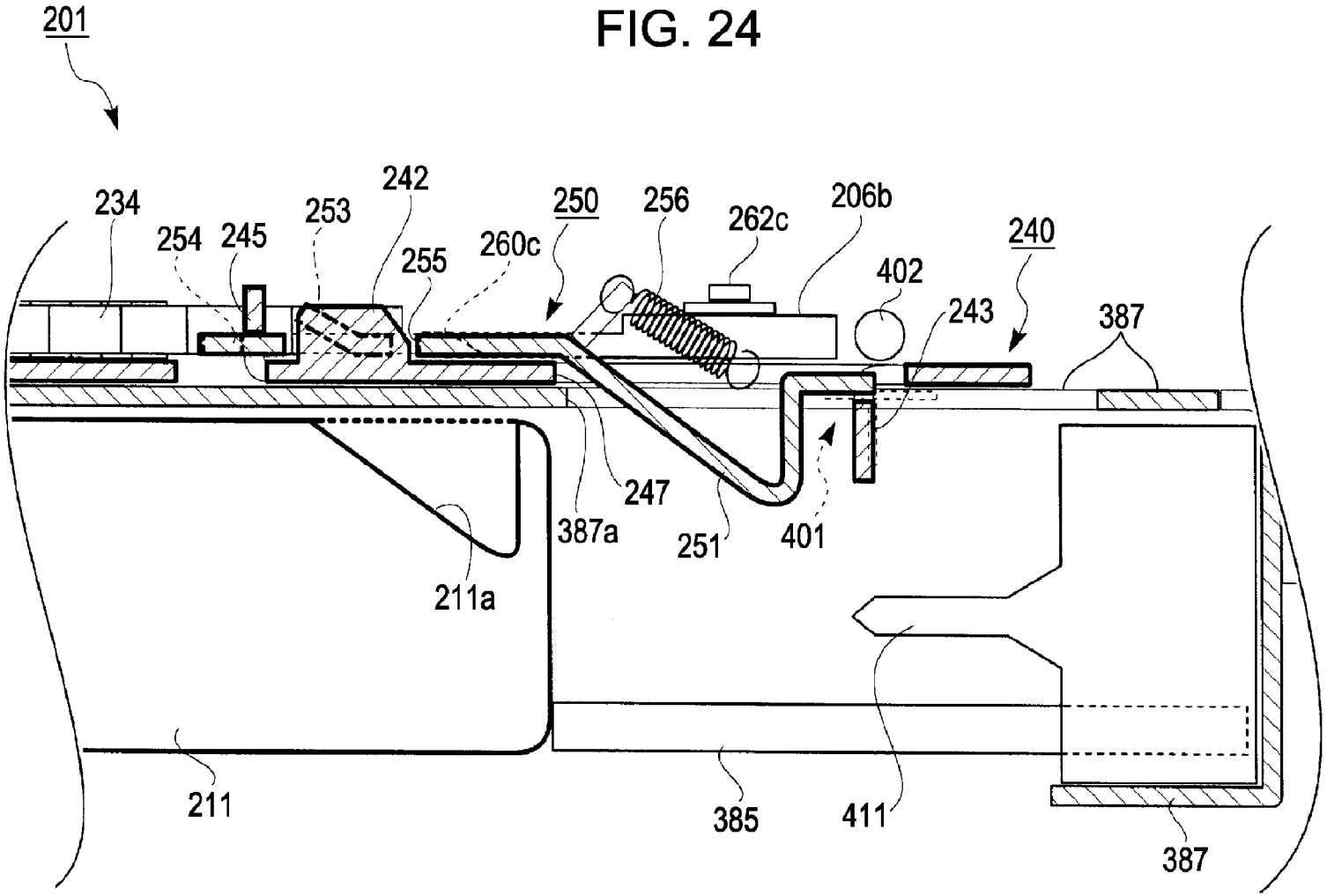
FIG. 24 is a side cross-sectional view of a relevant part of the attachment/detachment device when the ink cartridge is being ejected (the latch plate is lowered).

FIG. 24 is a side cross-sectional view of a relevant part of the attachment/detachment device when the ink cartridge is being ejected. As shown in FIG. 24, as the lever arm 363 is gradually pivoted further from a state shown in FIGS. 22 and 23 toward the reset position, the slider portion 240 is gradually moved further in the ejecting direction. At this time, the ink cartridge 211 is pushed out by the urging force of the first ejection lever 385. After that, the slope portions 253 of the latch plate 250 run over the distal end contact portions 260*c* of the cancel arms 260*a*, 260*b*. Accordingly, the latch plate 250 is lowered downward after the ink cartridge 211 is moved in the ejecting direction by the first ejection lever 385.

The ink cartridge 211 that has been moved in the ejecting direction by the first ejection lever 385 comes out halfway from the insertion opening 271 and then stops so that the ink cartridge 211 contacts the lever protrusion 363*c* of the lever arm 363. Thereafter, as the lever arm 363 is completely pivoted to the reset position (see FIGS. 4 to 6, 8 and 9) to make the lever protrusion 363*c* be moved outside of the approaching path A, the ink cartridge 211 may be taken out from the insertion opening 271.

First Embodiment

Figure 25:
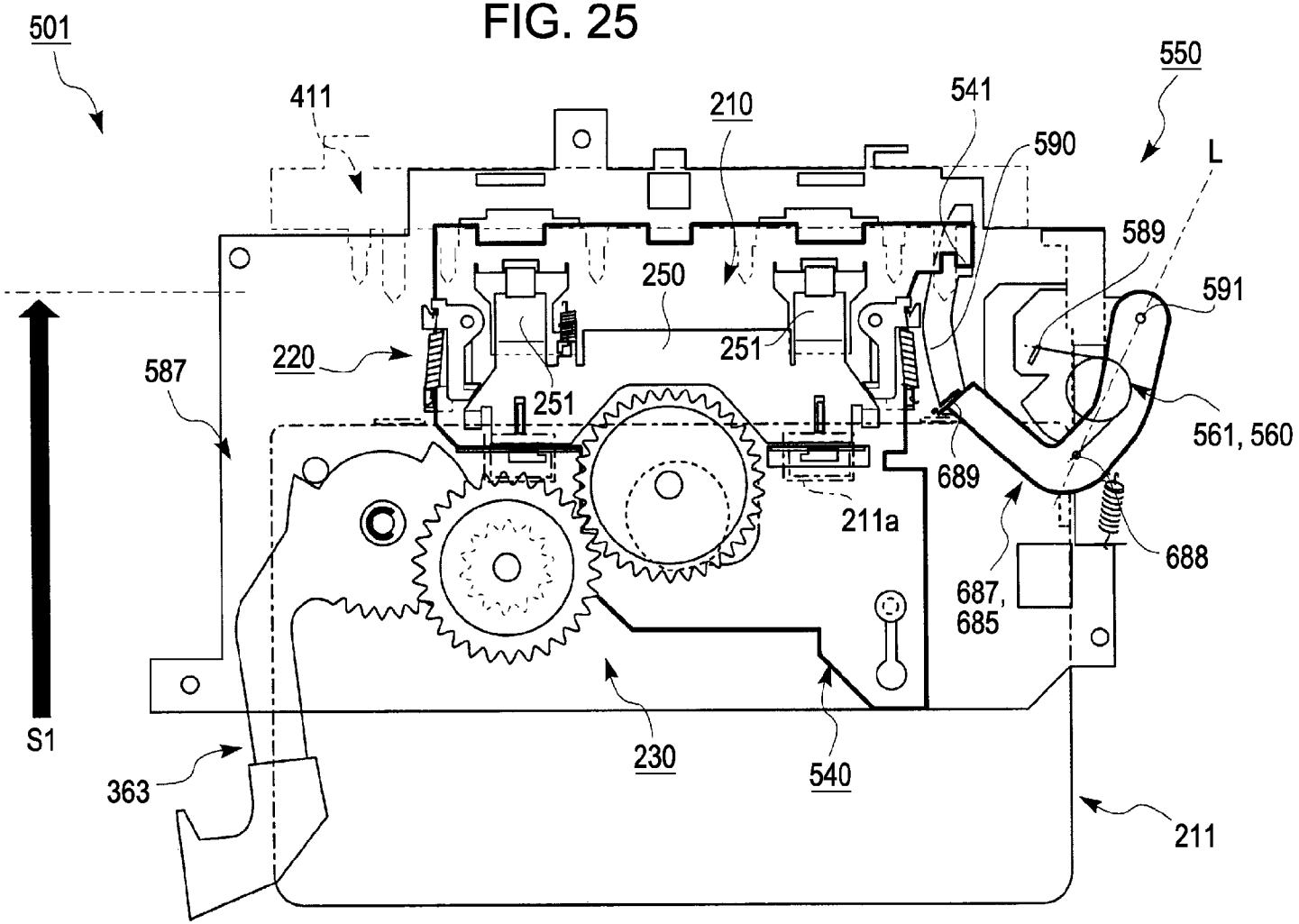
FIG. 25 is a plan view of an attachment/detachment device before an ink cartridge is inserted according to a first embodiment.
Figure 26:
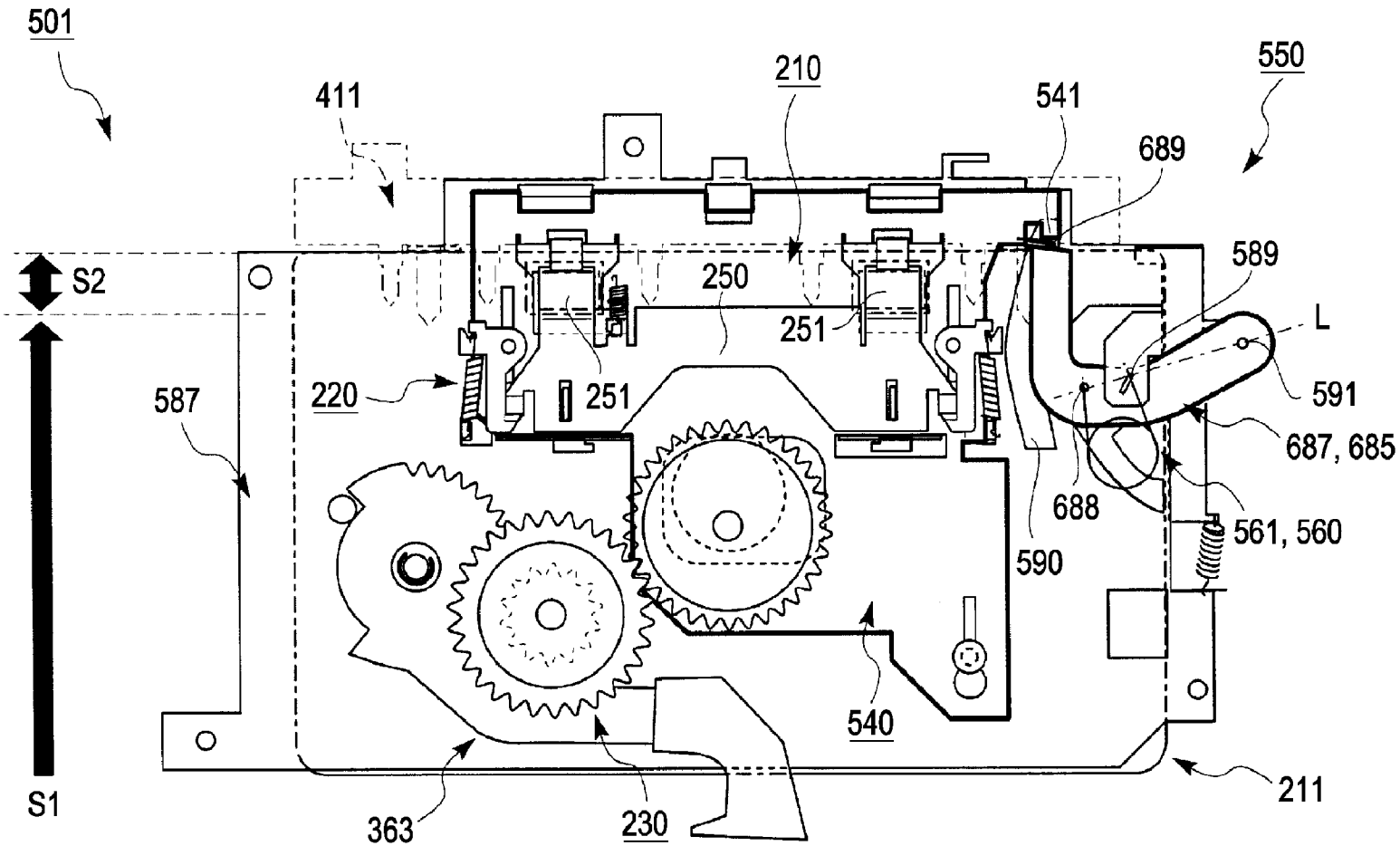
FIG. 26 is a plan view of the attachment/detachment device when the ink cartridge is completely loaded according to the first embodiment.
Figure 27:
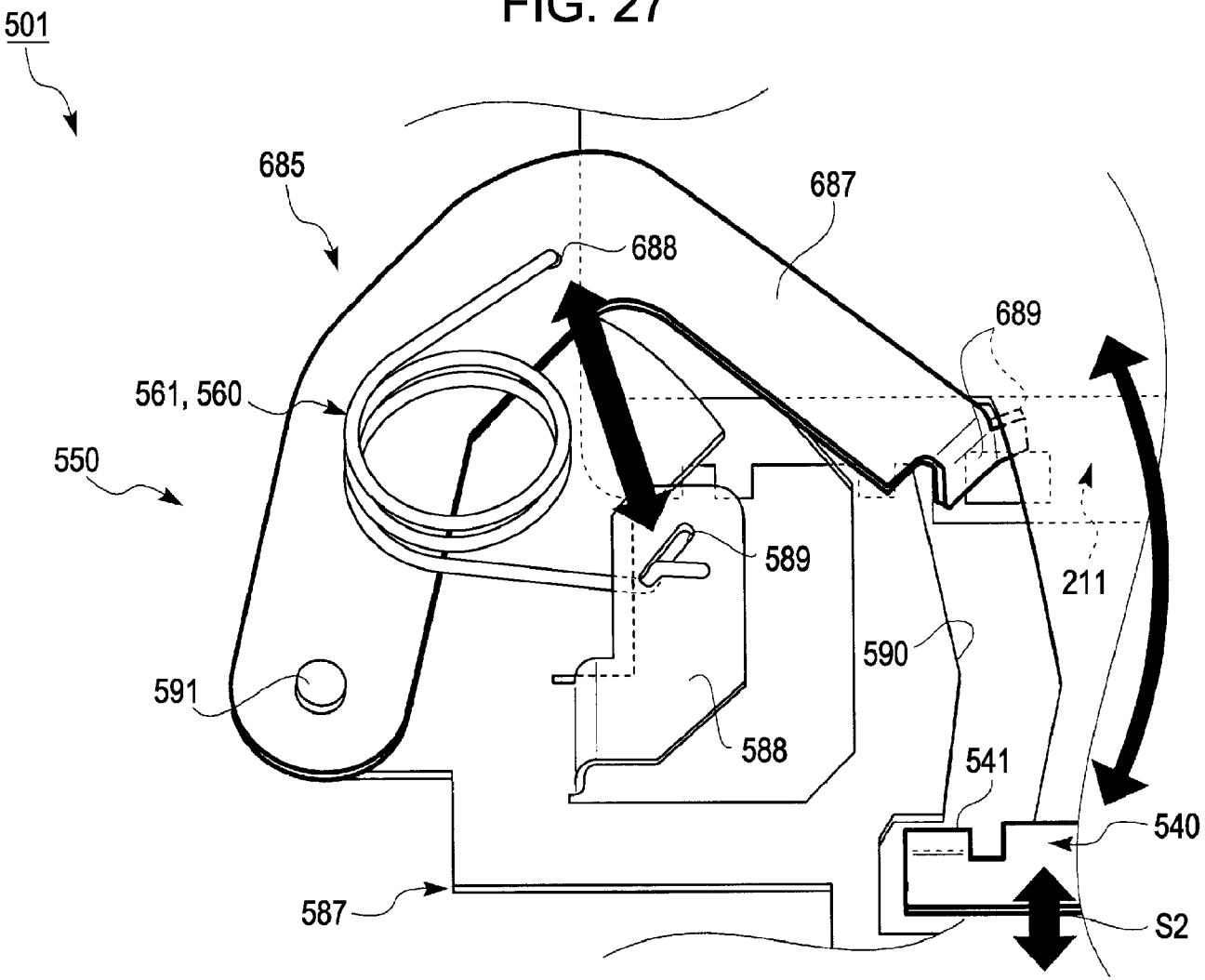
FIG. 27 is an enlarged perspective view of a relevant part of an urging force adjustment device before the ink cartridge is loaded according to the first embodiment.
Figure 28:
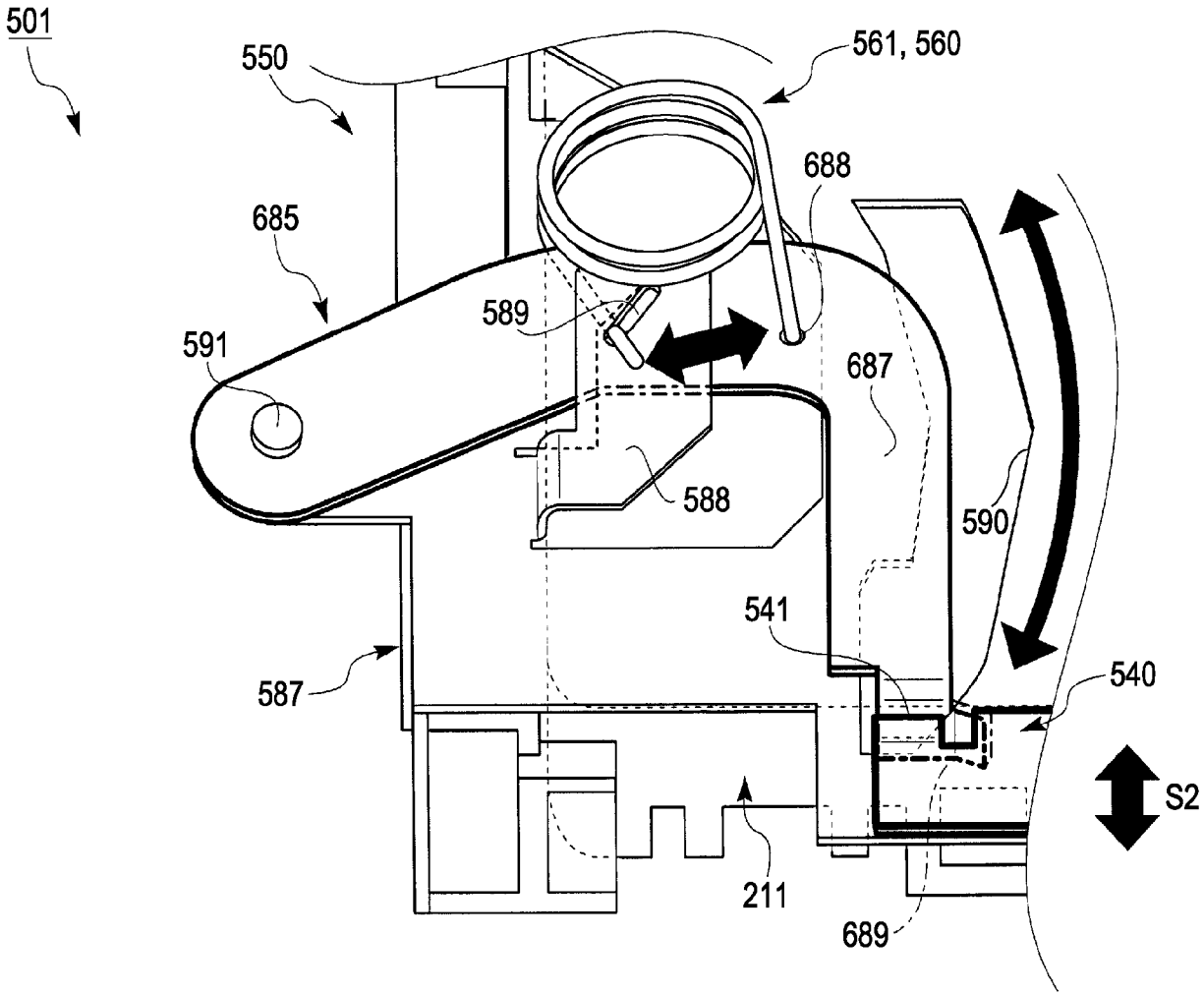
FIG. 28 is an enlarged perspective view of a relevant part of the urging force adjustment device when the ink cartridge is completely loaded according to the first embodiment.

Next, an attachment/detachment device of the ink cartridge according to a first embodiment of the invention will be described. FIG. 25 is a plan view of the attachment/detachment device before the ink cartridge of the first embodiment is inserted. FIG. 26 is a plan view of the attachment/detachment device when the ink cartridge of the first embodiment is completely loaded. FIG. 27 is an enlarged perspective view of a relevant part as viewed from the upstream side in the ejecting direction in FIG. 25. FIG. 28 is an enlarged perspective view of a relevant part as viewed from the upstream side in the ejecting direction in FIG. 26. In addition, FIGS. 29A and 29B each are a perspective view of a second ejection lever.

As shown in FIGS. 25 to 28, an ink cartridge attachment/detachment device 501 according to the first embodiment is provided with a second ejection lever 685. The second ejection lever 685 is arranged pivotally about a lever pivot shaft 591. The second ejection lever 685 is provided at its distal end with a lever contact portion 689 that is capable of contacting and pressing an upstream face of the ink cartridge 211 in the ejecting direction. The lever contact portion 689 extends from the upper surface of the base portion 587 thereinto through a substantially dogleg lever insertion opening 590, which is provided in the base portion 587 of the attachment/detachment device 501 (see FIG. 27).

Further, the second ejection lever 685 has a lever arm portion 687, which serves as an arm portion. The lever arm portion 687 has a lever spring engaging hole 688 with which a torsion coil spring 561 engages at one end. The torsion coil spring 561 engages at one end with the lever spring engaging hole 688 of the lever arm portion 687 of the second ejection lever 685 and engages at the other end with a base spring engaging hole 589, which is provided in a base spring engaging piece 588 (see FIGS. 27 and 28) of the base portion 587 of the attachment/detachment device 501. In other words, the torsion coil spring 561 is capable of pivoting the second ejection lever 685 in a counterclockwise direction in FIG. 25.

Furthermore, the attachment/detachment device 501 is provided with an urging force adjustment device 550 in which the torsion coil spring 561 adjusts the urging force that urges the second ejection lever 685 in the pivotal direction. The urging force adjustment device 550 includes the torsion coil spring 561, which is an example of the urging device 560, and the second ejection lever 685.

On the other hand, a slider portion 540 is provided with a slider contact portion 541 that is inserted into the lever insertion opening 590. Then, the slider contact portion 541 is contactable with the upstream side of the lever contact portion 689 of the second ejection lever 685 in the ejecting direction. That is, the upstream side of the lever contact portion 689 in the ejecting direction is contactable with the slider contact portion 541, while, on the other hand, the downstream side of the lever contact portion 689 in the ejecting direction (hereinafter, simply referred to as ejecting direction) is contactable with an upstream face of the ink cartridge 211 in the ejecting direction. Note that, because the other components are the same as those of the embodiment, the same reference numerals are used to denote the same or similar components, and a description thereof is omitted.

Insertion of Ink Cartridge

The ink cartridge 211 is pushed in from a reset state of the lever arm 363 shown in FIGS. 25 and 27 in the loading direction by the first predetermined stroke S1.

Then, the face of the ink cartridge 211 on the distal end side in the loading direction (which is the upstream side in the ejecting direction) contacts the lever contact portion 689 of the second ejection lever 685. Thereafter, the torsion coil spring 561 pushes in the ink cartridge 211 by the first predetermined stroke S1, while pivoting the second ejection lever 685 in the clockwise direction against the urging force that urges the second ejection lever 685 in the pivotal direction. The lever contact portion 689 is configured to pivot along the lever insertion opening 590.

As the ink cartridge 211 is pushed in by the first predetermined stroke S1, the ink cartridge 211 is held by the cartridge holder 210 as described above. Specifically, the pawl portions 251 of the latch plate 250 engage with the recesses 211*a* of the ink cartridge 211. Here, the movements of the latch plate 250, and the like, are the same as those of the embodiment described above. Therefore, a description thereof is omitted.

When the ink cartridge 211 is pushed in by the first predetermined stroke S1, as the second ejection lever 685 is pivoted in the clockwise direction, the straight line L formed by connecting the lever spring engaging hole 688 and the lever pivot shaft 591 approaches the base spring engaging hole 589. Here, the urging force of the torsion coil spring 561 applied to the second ejection lever 685 is divided into a force that urges the second ejection lever 685 in the pivotal direction and a force that urges the second ejection lever 685 in the radial direction about the lever pivot shaft 591. Then, as the second ejection lever 685 gradually pivots in the clockwise direction, the force that urges in the pivotal direction gradually reduces and the force that urges in the radial direction gradually increases. In other words, in accordance with the amount by which the ink cartridge 211 is pushed in, it is possible to push in the ink cartridge 211 with a smaller force.

Loading of Ink Cartridge

After the ink cartridge 211 is held by the cartridge holder 210, the lever arm 363 is pivoted from the reset position to the set position. With the pivotal movement of the lever arm 363, the slider portion 540, the latch plate 250 and the ink cartridge 211 are moved in the loading direction by the second predetermined stroke S2. At the same time, the ink cartridge 211 contacts the lever contact portion 689 of the second ejection lever 685 and pivots the second ejection lever 685 in the clockwise direction against the urging force. That is, when the ink cartridge 211 is moved in the loading direction by the second predetermined stroke S2 as well, as in the case that the ink cartridge 211 is moved by the first predetermined stroke S1, the urging force that the torsion coil spring 561 urges the second ejection lever 685 gradually reduces.

FIGS. 26 and 28 each are a state when the ink cartridge 211 is completely loaded. As shown in FIG. 26, the operating point of force at the base spring engaging hole 589 is on the straight line L formed by connecting the lever spring engaging hole 688 and the lever pivot shaft 591. Here, the urging force of the torsion coil spring 561 applied to the second ejection lever 685 is divided into a force that urges the second ejection lever 685 in the pivotal direction and a force that urges the second ejection lever 685 in the radial direction about the lever pivot shaft 591 as described above. Then, the force that urges the second ejection lever 685 in the pivotal direction becomes zero and only the force that urges the second ejection lever 685 in the radial direction exists. In other words, in a state when the loading of the ink cartridge 211 is completed as shown in FIGS. 26 and 28, the ejection force that the second ejection lever 685 acts on the ink cartridge 211 becomes zero. As a result, even when the ink cartridge 211 is left for a long time in a state when the loading of the ink cartridge 211 is completed, it is unlikely to develop a creep deformation in each member due to an ejection force of the second ejection lever 685.

The relationship between the pivotal movement of the second ejection lever 685 and the urging force in the pivotal direction will now be described. Here, where a force that is applied in the pivotal direction of the second ejection lever 685 is F, a vector angle made by the straight line, which is formed by connecting the lever spring engaging hole 688 and the lever pivot shaft 591, and a line, which is formed by connecting the base spring engaging hole 589 and the lever spring engaging hole 688, that is, an urging direction of the torsion coil spring 561, is θ, and the urging force of the torsion coil spring 561 is A, the relational expression $F=A \sin \theta$ is obtained. That is, the force F that is applied in the pivotal direction of the second ejection lever 685 sharply reduces immediately before the loading of the ink cartridge 211 is completed and then becomes zero. In addition, depending on variation of the sin θ, a ratio of the force F with which the torsion coil spring 561 urges the second ejection lever 685 in the pivotal direction to the force with which the torsion coil spring 561 urges the second ejection lever 685 in the radial direction varies.

Note that the force that moves the slider portion 540 in the loading direction by pivoting the lever arm 363 is sufficiently larger than the urging force F. Accordingly, it is unlikely for the urging force F, when the ink cartridge 211 is loaded, hinders the movement of the slider portion 540 and ink cartridge 211 in the loading direction. In addition, when the loading of the ink cartridge 211 is completed, the operating point of the force at the base spring engaging hole 589 is set between the lever spring engaging hole 688 and the lever pivot shaft 591. However, the operating point may be set closer to the distal end side than the lever spring engaging hole 688. In this case, the angle θ can be 90 degrees and, therefore, it is possible to make the urging force A of the torsion coil spring 561 become the force F that is applied in the pivotal direction of the second ejection lever 685 without loss. Hence, if it is configured that the angle θ can become 90 degrees in the range where the second ejection lever 685 pivots, it is extremely efficient when the ink cartridge 211 is ejected.

Furthermore, with the pivotal movement of the second ejection lever 685, the distance between the base spring engaging hole 589 and the lever spring engaging hole 688 varies. Owing to this variation, the urging force A of the torsion coil spring 561 varies but the amount of variation is small. In other words, the urging force A of the torsion coil spring 561 reduces as the second ejection lever 685 pivots in the ejecting direction, but the amount of variation is small. On the other hand, the amount of variation of the sin θ is configured to be much larger than the amount of variation of the urging force A. Accordingly, when the second ejection lever 685 pivots in the ejecting direction, the force F applied in the pivotal direction increases on the influence of the amount of variation of the sin θ.

Here, because of the amount of variation, or the like, of the torsion coil spring 561, which is an example of the urging device 560, when the second ejection lever 685 is pivoted from the position shown in FIG. 26 in the ejecting direction, the force F applied in the pivotal direction is desirably designed so as to increase from zero at once and then reduces. In this case, when the second ejection lever 685 is pivoted in the ejecting direction, it is possible to set the configuration so that the force F takes a maximum value, when the second ejection lever 685 is being pivoted and the direction in which the force F applied in the pivotal direction is in parallel to the ejecting direction. Thus, it is possible to efficiently use the ejection force.

In addition, the urging force A is configured to become approximately zero so that, when the second ejection lever 685 completes pivoting in the ejecting direction, the torsion coil spring 561 is loosened to the almost maximum to have the urging force A become approximately zero, whereby it is possible to make the force F become approximately zero. Thus, even when the attachment/detachment device 501 is left after the ink cartridge 211 is ejected, it is unlikely to develop a creep deformation.

In addition, it may be configured to prevent a so-called overshooting, that is, in a state where the loading of the ink cartridge 211 is completed, the slider contact portion 541 contacts the lever contact portion 689 to further pivot the second ejection lever 685 from a state shown in FIG. 26 in the clockwise direction. In this case, when the straight line L is set to pass over the base spring engaging hole 589, it is possible to prevent the torsion coil spring 561 from urging the second ejection lever 685 to further pivot in the clockwise direction.

Ejection of Ink Cartridge

When the ink cartridge 211 is ejected, the lever arm 363 is pivoted from the set position shown in FIG. 26 (FIG. 14 as in the case of the embodiment described above) to the reset position shown in FIG. 25 (FIG. 8 as in the case of the embodiment described above). At this time, as described above, the pivotal movement of the lever arm 363 is converted to the movement with which the slider portion 540 moves in the ejecting direction by the second predetermined stroke S2 by means of the power transmitting and converting mechanism 230.

Then, as shown in FIG. 28, when the slider contact portion 541 of the slider portion 540 moves in the ejecting direction (upward direction in the drawing) by the second predetermined stroke S2, the slider contact portion 541 contacts and presses the upstream side of the lever contact portion 689 of the second ejection lever 685 in the ejecting direction (downward direction in the drawing) to forcibly move the lever contact portion 689 in the ejecting direction. Thus, the second ejection lever 685 pivots slightly in the ejecting direction. That is, the operating point of force at the base spring engaging hole 589 leaves away from the straight line L formed by connecting the lever spring engaging hole 688 and the lever pivot shaft 591.

Then, when the urging force of the torsion coil spring 561 applied to the second ejection lever 685 is divided into a force that urges the second ejection lever 685 in the pivotal direction and a force that urges the second ejection lever 685 in the radial direction about the lever pivot shaft 591 as described above, the urging force in the pivotal direction arises. As the second ejection lever 685 pivots in the ejecting direction, the force that urges in the pivotal direction increases. Here, as described above, the relational expression F (force applied in the pivotal direction)=A (urging force of the torsion coil spring 561) sin θ (θ is an angle made by the straight line L and the direction in which the torsion coil spring 561 urges) is obtained.

Accordingly, it is possible for the slider contact portion 541 to sharply increase the force F applied in the pivotal direction by moving the lever contact portion 689 at a small distance. As a result, the ink cartridge 211 may be reliably moved in the ejecting direction. Here, the direction of F (force applied in the pivotal direction) varies with the pivotal movement of the second ejection lever 685; however, the closer the direction of F is in parallel to the ejecting direction when the F takes a maximum value, the more the force F is efficiently used as the ejection force.

Note that the force F applied in the pivotal direction is also configured to apply an ejection force to the ink cartridge 211 after the engagement between the pawl portions 251 of the latch plate 250 of the cartridge holder 210 and the recesses 211*a* of the ink cartridge 211 is released by the cartridge lock releasing device 220. Then, it is desirably configured so that the slider contact portion 541 pivots the second ejection lever 685 through the lever contact portion 689 after the engagement between the pawl portions 251 and the recesses 211*a* is released. As a result, it is unlikely to prevent releasing of the engagement between the pawl portions 251 and the recesses 211*a*.

In addition, it is desirably configured so that the lever contact portion 689 contacts the middle portion of the ink cartridge 211 in the width direction relative to the ejecting direction. In this case, it is possible to stabilize the attitude of the ink cartridge 211 when the ink cartridge 211 is ejected. Furthermore, the downstream end of the pivotal stroke of the second ejection lever 685 in the ejecting direction is set so that the downstream end of the lever insertion opening 590 in the ejecting direction contacts and regulates the lever contact portion 689. Then, it is desirable that the urging force A of the torsion coil spring 561 is reduced to softly contact and regulate the lever contact portion 689.

Moreover, the attachment/detachment device 501 according to the first embodiment has the urging force adjustment device 550 and thereby making it possible to reliably ensure the ejection force. Therefore, it is not necessary to include the first ejection lever 385 and the push-out lever 401 as in the case of the embodiment. Thus, in comparison to the above-described embodiment, it is possible to reduce the number of components.

Figure 29A:
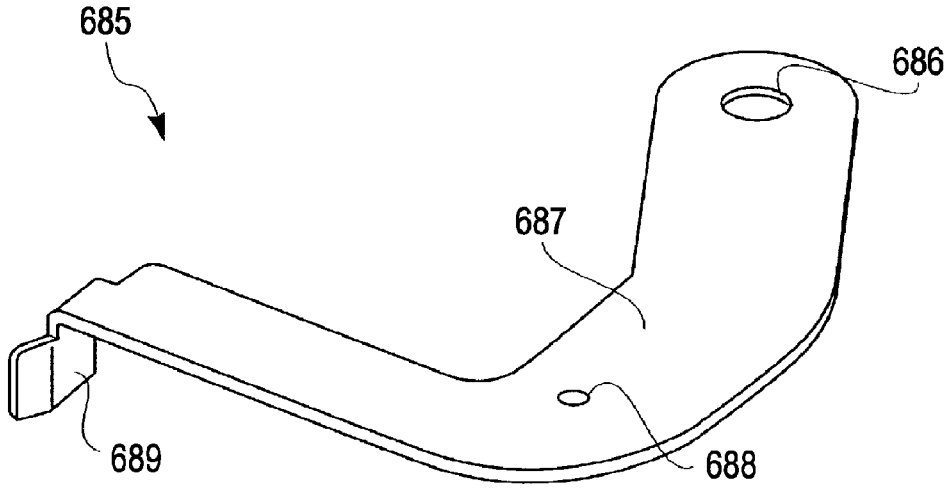
FIGS. 29A and 29B each are a perspective view of an ejection lever according to the first embodiment.
Figure 29B:
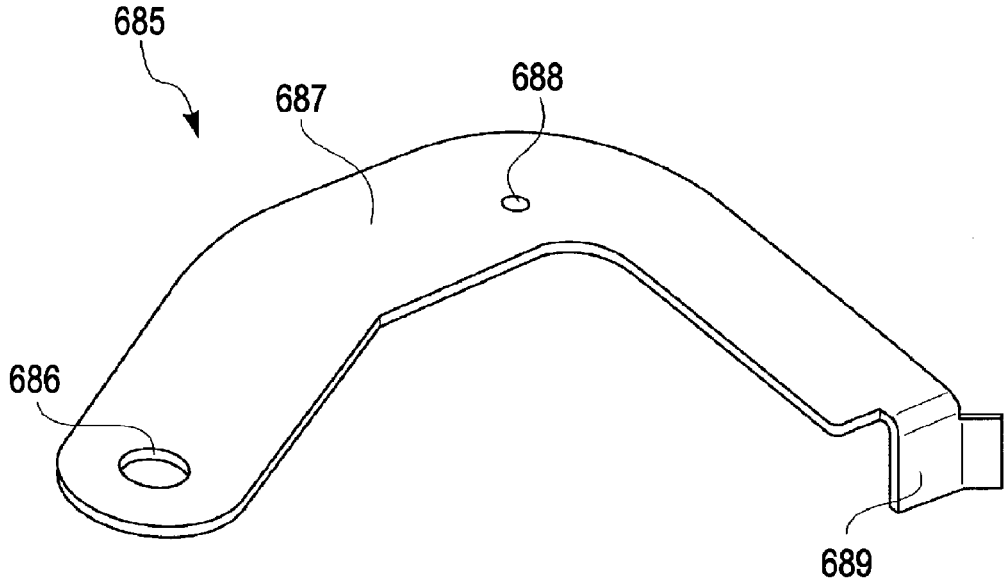

FIG. 29A is an upper perspective view as viewed from the downstream side of the second ejection lever in the ejecting direction toward the upstream side thereof (in the loading direction). On the other hand, FIG. 29B is an upper perspective view as viewed from the upstream side of the second ejection lever in the ejecting direction toward the downstream side thereof. As shown in FIGS. 29A and 29B, the second ejection lever 685 is provided with a lever fulcrum hole 686 that pivotally engages with a lever pivot shaft 591. The lever pivot shaft is provided on the base portion 587 of the attachment/detachment device 501. In addition, the second ejection lever 685 is provided with the lever arm portion 687 having an L-shape in plan view. Furthermore, the second ejection lever 685 includes the above described lever spring engaging hole 688 and the above described lever contact portion 689.

The attachment/detachment device 501 of the ink cartridge loads the ink cartridge 211 into the main body of the recording apparatus by sliding the ink cartridge 211 into. The attachment/detachment device 501 includes the second ejection lever 685 and the urging force adjustment device 550. The second ejection lever 685 is an ejection lever that contacts the ink cartridge 211 to urge the ink cartridge 211 in the ejecting direction by the urging force of the torsion coil spring 561, serving as the urging device 560, when the ink cartridge 211 is loaded or when the ink cartridge 211 is ejected. The urging force adjustment device 550 adjusts the force with which the torsion coil spring 561 urges the second ejection lever 685 in the pivotal direction. The urging force adjustment device 550 is configured to eliminate the force F that the torsion coil spring 561 applies in the pivotal direction of the second ejection lever 685 when the ink cartridge 211 is completely loaded.

In addition, the ink cartridge attachment/detachment device 501 according to the first embodiment loads the ink cartridge 211 into the main body of the recording apparatus by sliding the ink cartridge 211 into. The attachment/detachment device 501 includes the second ejection lever 685 and the urging force adjustment device 550. The second ejection lever 685 is an ejection lever that contacts the ink cartridge 211 to urge the ink cartridge 211 in the ejecting direction by the urging force of the torsion coil spring 561, serving as the urging device 560, when the ink cartridge 211 is loaded or when the ink cartridge 211 is ejected. The urging force adjustment device 550 changes a ratio of the force with which the torsion coil spring 561 urges the second ejection lever 685 in the pivotal direction to the force with which the torsion coil spring 561 urges the second ejection lever 685 in the radial direction about the lever pivot shaft 591, serving as the pivotal fulcrum. The urging force adjustment device 550 is configured to reduce the ratio of the force with which the torsion coil spring 561 urges the second ejection lever 685 in the radial direction as the second ejection lever 685 pivots in the ejecting direction and to increase the ratio of the force with which the torsion coil spring 561 urges the second ejection lever 685 in the radial direction as the second ejection lever 685 pivots in the loading direction.

Furthermore, in the ink cartridge attachment/detachment device 501 according to the first embodiment, the torsion coil spring 561 engages at one end with the base spring engaging hole 589 of the base spring engaging piece 588, which is provided on the base portion 587 of the attachment/detachment device 501 and engages at the other end with the lever spring engaging hole 688 of the lever arm portion 687, which is an arm portion of the second ejection lever 685. The urging force adjustment device 550 is configured to adjust the force applied in the pivotal direction of the second ejection lever 685 so that the straight line L formed by connecting the lever pivot shaft 591, which is the pivotal fulcrum of the second ejection lever 685, and the lever spring engaging hole 688 at which the second ejection lever 685 engages with the torsion coil spring 561 on the lever arm portion 687 approaches or moves away relative to the base spring engaging hole 589, at which the base portion 587 engages with the torsion coil spring 561, as the second ejection lever 685 pivots.

Further, in the ink cartridge attachment/detachment device 501 according to the first embodiment, when the ink cartridge 211 is completely loaded, the base spring engaging hole 589 at which the base portion 587 engages with the torsion coil spring 561, the lever pivot shaft 591 about which the second ejection lever 685 is pivoted, and a lever spring engaging hole 688 at which the lever arm portion 687 of the second ejection lever 685 engages with the torsion coil spring 561 are configured to be aligned on the same line.

In addition, the ink cartridge attachment/detachment device 501 according to the first embodiment includes the cartridge holder 210 and the power transmitting and converting mechanism 230. The cartridge holder 210 holds the ink cartridge 211 when the ink cartridge 211 is inserted by the first predetermined stroke S1. The power transmitting and converting mechanism 230 ensures a pressing force required for loading the ink cartridge 211 by pivoting the lever arm 363 using the leverage principle, while converting the pivotal movement of the lever arm 363 to the movement of the second predetermined stroke S2 required for loading the ink cartridge 211 which is held by the cartridge holder 210. The cartridge holder 210 moves in the ejecting direction by the second predetermined stroke S2 as it releases the ink cartridge 211 being held by the pivotal movement of the lever arm 363 when the ink cartridge 211 is ejected. The slider contact portion 541 of the cartridge holder 210 contacts the lever contact portion 689 of the second ejection lever 685 to pivot in the ejecting direction within the range of the second predetermined stroke S2, while the urging force adjustment device 550 increases the urging force that the torsion coil spring 561 applies in the ejecting direction, which is the pivotal direction of the second ejection lever 685.

Moreover, the ink cartridge attachment/detachment device 501 according to the first embodiment is configured so that, when the ink cartridge 211 is ejected, the slider contact portion 541 of the cartridge holder 210 pivots the second ejection lever 685 after the ink cartridge 211 that is held by the cartridge holder 210 is released. Yet furthermore, in the first embodiment, the second ejection lever 685 is desirably configured so as to contact and press the middle portion of the ink cartridge 211 in the width direction of the ink cartridge 211 relative to the ejecting direction. Here, the middle portion means a portion close to a middle and spaced away from ends and includes a range having a certain width in the width direction from the center line.

In addition, the recording apparatus 100 according to this embodiment includes the ink cartridge attachment/detachment device 501 and the recording portion 143 that performs recording by discharging ink onto a paper sheet serving as a recording medium when the ink cartridge 211 is loaded into the main body of the recording apparatus by sliding the ink cartridge 211 into.

Note that the second ejection lever has an L-shape in plan view but it may be formed in a straight line that connects the lever pivot shaft and the lever contact portion. Furthermore, the more the line formed by connecting the base spring engaging hole at which the base portion engages with the torsion coil spring and the lever spring engaging hole at which the lever arm portion of the second ejection lever engages with the torsion coil spring is parallel to the ejecting direction of the ink cartridge upon ejection, the more the urging force of the torsion coil spring is used as the ejection force without loss. Still furthermore, the invention is not limited to the embodiments described above but it may be modified into various alternative embodiments within the scope of the invention as set forth in the appended claims. The invention also encompasses these alternative embodiments.

The disclosure of Japanese Patent Application No. 2006-179935 filed Jun. 29, 2006 including specification, drawings and claims is incorporated herein by reference in its entirety.

What is claimed is:

1. An ink cartridge attachment/detachment device that loads an ink cartridge into a main body of a recording apparatus, the ink cartridge attachment/detachment device comprising:

an ejection lever that contacts the ink cartridge and urges the ink cartridge using an urging force of an urging device in an ejecting direction in which the ink cartridge is ejected when the ink cartridge is loaded or when the ink cartridge is ejected, wherein the ejection lever includes an elongated portion located at an opposite end of the ejection lever from a pivotal fulcrum of the ejection lever;

a sliding plate contact portion that contacts the elongated portion of the ejection lever, wherein movement of the sliding plate contact portion causes the ejection lever to pivot;

a power transmitting and converting mechanism that includes a lever arm that is different from the ejection lever, at least one gear operably coupled to the lever arm, and a sliding plate including the sliding plate contact portion, wherein the sliding plate is operably coupled to the at least one gear, the lever arm being configured to pivot from a first location to a second location when the ink cartridge is loaded into the main body of the recording apparatus and configured to pivot from the second location to the first location when the ink cartridge is removed from the main body of the recording apparatus, the power transmitting and converting mechanism ensuring that a pressing force required for loading the ink cartridge by using a leverage principle when the lever arm is pivoted, while the power transmitting and converting mechanism converts a pivotal movement of the lever arm into a movement required for loading the ink cartridge which is held by an ink cartridge holder; and an urging force adjustment device that changes a ratio of a force with which the urging device urges the ejection lever in a pivotal direction in which the ejection lever is pivoted to a force with which the urging device urges the ejection lever in a radial direction about the pivotal fulcrum of the ejection lever, wherein the urging force adjustment device reduces the force with which the urging device urges the ejection lever in the radial direction as the ejection lever is pivoted in the ejecting direction, and the urging force adjustment device increases the force by which the urging device urges the ejection lever in the radial direction as the ejection lever is pivoted in a loading direction in which the ink cartridge is loaded.

2. The ink cartridge attachment/detachment device according to claim 1, wherein the urging device is engaged at one end with a base portion of the ink cartridge attachment/detachment device, while the urging device is engaged at the other end with an arm portion of the ejection lever, and the urging force adjustment device adjusts a force that is applied in the pivotal direction of the ejection lever so that, as the ejection lever is pivoted, a straight line formed by connecting the pivotal fulcrum of the ejection lever and an engaging portion at which the arm portion of the ejection lever engages the urging device approaches and then moves away from an engaging portion at which the base portion engages the urging device.

3. The ink cartridge attachment/detachment device according to claim 2, further comprising:

the cartridge holder that is made to hold the ink cartridge by inserting the ink cartridge by a first predetermined stroke wherein when the ink cartridge is ejected, the cartridge holder is moved in the ejecting direction by the second predetermined stroke as the cartridge holder releases the ink cartridge held by the cartridge holder by pivotal movement of the lever arm, and the cartridge holder contacts the ejection lever to pivot the ejection lever in the ejecting direction within a range of the second predetermined stroke, while the cartridge holder makes the urging force adjustment device increase an urging force that the urging device applies in the ejecting direction that coincides with the pivotal direction of the ejection lever.

4. The ink cartridge attachment/detachment device according to claim 3, wherein, when the ink cartridge is ejected, the cartridge holder pivots the ejection lever after the cartridge holder has released the ink cartridge.

5. The ink cartridge attachment/detachment device according to claim 4, wherein, in a state where the ink cartridge is completely loaded, the engaging portion, at which the base portion engages the urging device, the pivotal fulcrum of the ejection lever and the engaging portion, at which the arm portion of the ejection lever engages the urging device, are aligned in a line.

6. The ink cartridge attachment/detachment device according to claim 1, wherein the ejection lever is configured so as to contact and press a middle portion of the ink cartridge in a width direction relative to the ejecting direction of the ink cartridge.

7. A recording apparatus, comprising:

the ink cartridge attachment/detachment device according to claim 1; and a recording portion that performs recording by discharging ink onto a recorded medium.

* * * * *